US010272698B2

(12) United States Patent
Kodama et al.

(10) Patent No.: US 10,272,698 B2
(45) Date of Patent: Apr. 30, 2019

(54) POST PROCESSING DEVICE AND PRINTING SYSTEM

(71) Applicant: SEIKO EPSON CORPORATION, Tokyo (JP)

(72) Inventors: Hidetoshi Kodama, Nagano (JP); Hirohisa Adachi, Nagano (JP); Yutaro Harada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/642,655

(22) Filed: Jul. 6, 2017

(65) Prior Publication Data

US 2018/0015738 A1 Jan. 18, 2018

(30) Foreign Application Priority Data

| | | |
|---|---|---|
| Jul. 13, 2016 | (JP) | 2016-138251 |
| Jul. 13, 2016 | (JP) | 2016-138252 |
| Jul. 13, 2016 | (JP) | 2016-138253 |
| Jul. 13, 2016 | (JP) | 2016-138256 |
| Jul. 13, 2016 | (JP) | 2016-138257 |
| Aug. 9, 2016 | (JP) | 2016-156219 |
| Apr. 28, 2017 | (JP) | 2017-089382 |
| Apr. 28, 2017 | (JP) | 2017-089383 |

(51) Int. Cl.
*B41J 11/00* (2006.01)
*B41J 13/26* (2006.01)
(Continued)

(52) U.S. Cl.
CPC ..... *B41J 11/006* (2013.01); *B41J 11/0005* (2013.01); *B41J 13/26* (2013.01); *B65H 29/125* (2013.01); *B65H 29/14* (2013.01); *B65H 31/02* (2013.01); *B65H 31/3027* (2013.01); *B41J 29/377* (2013.01); *B65H 2301/33312* (2013.01); *B65H 2301/4212* (2013.01); *B65H 2301/4213* (2013.01); *B65H 2301/4461* (2013.01); *B65H 2301/5142* (2013.01);
(Continued)

(58) Field of Classification Search
CPC ..... B41J 29/38; B41J 11/007; B41J 13/103; B41J 29/393; B41J 11/0095; B41J 11/0005; B41J 11/005; B41J 11/006; B41J 15/16; B41J 13/10; B41J 13/00; B41J 13/02; B41J 13/26; B65H 29/14
USPC ..... 347/16, 19, 101, 104
See application file for complete search history.

(56) References Cited

U.S. PATENT DOCUMENTS 6,003,861 A 12/1999 Iizumi et al.
6,171,225 B1 1/2001 Nonoyama et al.
(Continued)

FOREIGN PATENT DOCUMENTS

JP 08-175732 A 7/1996
JP 09-263355 A 10/1997
(Continued)

OTHER PUBLICATIONS

The Extended European Search Report for the corresponding European Patent Application No. 17180441.2 dated Dec. 8, 2017.

*Primary Examiner* — Jannelle M Lebron

(57) ABSTRACT

There is provided a post processing device including a mounting portion on which a medium is temporarily mounted, a post processing unit that performs post processing on the medium mounted on the mounting portion, a discharging tray on which the medium is stacked after being discharged, and a suppressing unit that suppresses deformation of the medium mounted on the mounting portion.

16 Claims, 13 Drawing Sheets

(51) Int. Cl.

| | |
|---|---|
| ***B65H 29/12*** | (2006.01) |
| ***B65H 29/14*** | (2006.01) |
| ***B65H 31/02*** | (2006.01) |
| ***B65H 31/30*** | (2006.01) |
| *B41J 29/377* | (2006.01) |
| *G03G 15/00* | (2006.01) |

(52) U.S. Cl.

CPC ..... *B65H 2301/51256* (2013.01); *B65H 2404/1441* (2013.01); *B65H 2404/693* (2013.01); *B65H 2405/11151* (2013.01); *B65H 2511/224* (2013.01); *B65H 2511/528* (2013.01); *B65H 2601/11* (2013.01); *B65H 2801/15* (2013.01); *B65H 2801/27* (2013.01); *G03G 15/6567* (2013.01); *G03G 15/6576* (2013.01); *G03G 2215/00662* (2013.01)

(56) References Cited

U.S. PATENT DOCUMENTS

| | | | |
|---|---|---|---|
| 6,308,026 | B1 | 10/2001 | Kouchi |
| 6,460,687 | B1 | 10/2002 | Escobedo et al. |
| 2007/0048048 | A1 | 3/2007 | Kougami et al. |
| 2008/0224386 | A1 | 9/2008 | Kunieda et al. |
| 2009/0184466 | A1 | 7/2009 | Maeda et al. |
| 2010/0002037 | A1 | 1/2010 | Kusuhata |
| 2010/0225044 | A1 | 9/2010 | Tsuji |
| 2011/0140343 | A1 | 6/2011 | Tanaka et al. |
| 2011/0229240 | A1 | 9/2011 | Shibayama |
| 2013/0004652 | A1 | 1/2013 | Furukawa |
| 2014/0062005 | A1 | 3/2014 | Suzuki et al. |
| 2014/0354728 | A1 | 12/2014 | Murata et al. |
| 2015/0116411 | A1 | 4/2015 | Suzuki |
| 2015/0151944 | A1 | 6/2015 | Shirasaki et al. |
| 2015/0266320 | A1 | 9/2015 | Kokura |
| 2016/0023858 | A1 | 1/2016 | Mizuno |
| 2016/0031234 | A1 | 2/2016 | Segawa |

FOREIGN PATENT DOCUMENTS

| | | | |
|---|---|---|---|
| JP | 09-295759 | A | 11/1997 |
| JP | 10-250902 | A | 9/1998 |
| JP | 2001-002313 | A | 1/2001 |
| JP | 2008-132692 | A | 6/2008 |
| JP | 2008-165959 | A | 11/2008 |
| JP | 2010-202383 | A | 9/2010 |
| JP | 2012-139820 | A | 7/2012 |
| JP | 2013-006322 | A | 1/2013 |
| JP | 2015-107840 | A | 6/2015 |
| JP | 2015-174331 | A | 10/2015 |

POST PROCESSING DEVICE AND PRINTING SYSTEM

BACKGROUND

1. Technical Field

The present invention relates to a post processing device and a printing system.

2. Related Art

In the related art, there is known a post processing device which includes a mounted sheet processing unit that performs post processing such as a stapling process or a shifting process with respect to a paper sheet on which an image has been formed (for example, refer to JP-A-2015-107840). In the post processing device, the post processing is performed in a state where a plurality of paper sheets on each of which an image has been formed are mounted on a processing tray.

Note that, as an apparatus which forms an image on a paper sheet, there is known an ink jet printer or the like, which includes a recording head that ejects ink as liquid in the form of ink droplets, for example.

Meanwhile, in a case where an image is formed by means of an ink jet printer, a paper sheet on which an image has been formed may curl (a portion of the paper sheet may curve) due to absorption of ink (moisture), the drying of ink, and the like.

Therefore, in a case where paper sheets on each of which an image has been formed by the ink jet printer are sequentially mounted on the processing tray of the post processing device, if the degree of curling of a paper sheet that is mounted earlier is great, a paper sheet that is mounted later is caught on a curled portion of the paper sheet mounted earlier so that misalignment of the paper sheets or transportation failure occurs.

SUMMARY

The invention can be realized in the following aspects or application examples.

Application Example 1

According to this application example, there is provided a post processing device including a mounting portion on which a medium, on which liquid has been ejected and an image has been formed in a printing device, is temporarily mounted, a post processing unit that performs post processing on the medium mounted on the mounting portion, a discharging tray on which the medium is stacked after being discharged, and a suppressing unit that suppresses deformation of the medium mounted on the mounting portion.

According to this configuration, the medium on which an image or the like has been formed can be mounted on the mounting portion and the post processing can be performed on the medium mounted on the mounting portion by using the post processing unit.

Here, examples of a method of forming an image on a medium such as a paper sheet include a method of using an ink jet printer that ejects ink as liquid in the form of ink droplets.

However, the medium on which an image has been formed in the ink jet printer may curl due to absorption of ink (moisture), the drying of ink, an image forming method (for example, simplex printing or duplex printing), or the like. Therefore, in a case where mediums on each of which an image has been formed in the ink jet printer are mounted on the mounting portion, there is a possibility that one of the mounted mediums curls and another medium is caught on a curled portion of the one medium so that misalignment of the mediums, transportation failure, or the like occurs.

Therefore, in the above-described configuration, the suppressing unit suppresses deformation such as the curling of the medium mounted on the mounting portion. Accordingly, it is possible to suppress misalignment of mediums, transportation failure, or the like.

Application Example 2

In the post processing device according to the application example, in a case where a situation in which the medium is not transported in a transportation path that is on the upstream side of the mounting portion occurs, the suppressing unit preferably suppresses the deformation of the medium.

In a case where a situation in which the medium is not transported in a transportation path that is on the upstream side of the mounting portion (for example, a situation in which the medium is jammed, a situation in which a cover (front plate cover 104 and intermediate transportation path cover (not shown)) covering the transportation path is opened, or a situation in which ink has run out) occurs, transportation of the medium is stopped and the situation in which the medium is transported is solved. However, the deformation (curling) amount of a medium already mounted on the mounting portion increases while the situation in which the medium is not transported is solved and the transportation of the medium is restarted. Therefore, when the situation in which the medium is not transported is solved and the transportation of the medium is restarted, a portion of another medium may be caught on a curled portion of the medium already mounted on the mounting portion.

Therefore, in the above-described configuration, the suppressing unit suppresses deformation of the medium mounted on the mounting portion in a case where the situation in which the medium is not transported occurs. Accordingly, the curling of the medium is suppressed and thus it is possible to suppress transportation failure of the medium or the like.

Application Example 3

In the post processing device according to the application example, the situation in which the medium is not transported is preferably a situation in which the medium is jammed in the transportation path that is on the upstream side of the mounting portion.

According to this configuration, the suppressing unit suppresses the deformation of the medium mounted on the mounting portion in a case where the medium is jammed. Therefore, the curling of the medium is suppressed and thus it is possible to suppress transportation failure of the medium or the like.

Application Example 4

In the post processing device according to the application example, the suppressing unit preferably suppresses the deformation of the medium between the mounting portion and the discharging tray.

According to this configuration, the suppressing unit has a function of suppressing the curling of the medium between the mounting portion and the discharging tray. That is, the suppressing unit suppresses the curling of the medium on the outside of the mounting portion. Accordingly, the suppressing unit can suppress the curling of the medium with the mounting portion not being involved with the suppression.

Application Example 5

In the post processing device according to the application example, the suppressing unit preferably includes a first roller and a second roller, a gap in a direction in which the medium is interposed between the first roller and the second roller is preferably changeable to a first gap and a second gap that is a gap smaller than the first gap, and in a case where a situation in which the medium is not transported in a transportation path that is on the upstream side of the mounting portion occurs, the gap between the first roller and the second roller is preferably changed to the second gap with the medium, which is mounted on the mounting portion, being interposed between the first roller and the second roller.

In a case where the medium is jammed on the upstream side of the mounting portion in the transportation path of the medium, the transportation of the medium is stopped and the jam is fixed. However, the deformation (curling) amount of a medium already mounted on the mounting portion increases while the jam is fixed and the transportation of the medium is restarted. Therefore, when the jam is fixed and the transportation of the medium to the mounting portion is restarted, a portion of another medium may be caught on a curled portion of the medium already mounted on the mounting portion.

Therefore, in the above-described configuration, in a case where the medium is jammed, the gap between the first roller and the second roller is changed from the first gap to the second gap with the medium, which is mounted on the mounting portion, being interposed between the first roller and the second roller. That is, the gap between the first roller and the second roller becomes small. Accordingly, the curling of the medium placed on the mounting portion is easily restricted by the first roller and the second roller. Therefore, the curling of the medium is suppressed and thus it is possible to suppress transportation failure of the medium or the like.

Application Example 6

In the post processing device according to the application example, in a case where the gap is the first gap, any one of the first roller and the second roller preferably does not come into contact with the medium, and in a case where the gap is the second gap, the first roller and the second roller preferably come into contact with the medium.

According to this configuration, since the medium is nipped between the first roller and the second roller with the gap being changed from the first gap to the second gap, it is possible to reliably suppress the curling of the medium.

Application Example 7

In the post processing device according to the application example, the suppressing unit preferably suppresses the deformation of the medium on the mounting portion.

According to this configuration, the suppressing unit has a function of suppressing the curling of the medium on the mounting portion. That is, the suppressing unit can suppress the curling of the medium with a portion of the mounting portion being involved with the suppression.

Application Example 8

In the post processing device according to application example, the suppressing unit preferably includes a contact portion that comes into contact with a surface of the medium, a gap between the medium mounted on the mounting portion and the contact portion is preferably changeable to a first gap and a second gap that is a gap smaller than the first gap, and in a case where a situation in which the medium is not transported in a transportation path that is on the upstream side of the mounting portion occurs, the gap between the medium mounted on the mounting portion and the contact portion is preferably changed to the second gap.

According to this configuration, in a case where the medium is jammed on the upstream side of the mounting portion in the transportation path of the medium, the gap between the medium mounted on the mounting portion and the contact portion is changed from the first gap to the second gap. That is, the gap between the medium and the contact portion becomes small. Accordingly, the curling of the medium placed on the mounting portion is easily restricted by the contact portion. Therefore, the curling of the medium is suppressed and thus it is possible to suppress transportation failure of the medium.

Application Example 9

In the post processing device according to the application example, in a case where the gap is the first gap, the contact portion preferably does not come into contact with the medium, and in a case where the gap is the second gap, the contact portion preferably comes into contact with the medium.

According to this configuration, since the medium comes into contact with the contact portion with the gap being changed from the first gap to the second gap, it is possible to reliably suppress the curling of the medium.

Application Example 10

In the post processing device according to the application example, the suppressing unit is preferably an air blower, and in a case where a situation in which the medium is not transported in a transportation path that is on the upstream side of the mounting portion occurs, air is preferably sent to the medium mounted on the mounting portion.

According to this configuration, it is possible to easily suppress deformation such as the curling of the medium using the air pressure of the sent air.

Application Example 11

In the post processing device according to the application example, the suppressing unit preferably includes a moisturizing unit that moisturizes the medium mounted on the mounting portion, and in a case where a situation in which the medium is not transported in a transportation path that is on the upstream side of the mounting portion occurs, the medium mounted on the mounting portion is preferably moisturized.

According to this configuration, in a case where the medium is jammed, the deformation of the medium is suppressed with the medium being moisturized. Therefore, it is possible to more efficiently suppress the curling of the medium.

Application Example 12

In the post processing device according to the application example, the suppressing unit is preferably driven after the medium on the downstream side of a position, at which the jam occurs, in the transportation path is transported to the mounting portion.

According to this configuration, in a case where the medium is jammed on the upstream side of the mounting portion in the transportation path of the medium, a normal medium which is between the mounting portion and a position at which the jam occurs is transported to the mounting portion. Thereafter, the suppressing unit is driven. Therefore, it is possible to prevent disposal of a normal medium (medium that is not jammed) and to achieve resource saving.

Application Example 13

In the post processing device according to the application example, in a case where the jam is fixed, the suppressing unit is preferably deactivated on the basis of the result of detection performed by a detecting unit that is disposed in the transportation path on the upstream side of the suppressing unit and is closest to the suppressing unit.

In a case where the jam is fixed, the suppressing unit is deactivated and the transportation of the medium is restarted. However, in a case where a time taken for the first medium which is transported after the jam is fixed to be mounted on the mounting portion is relatively long, a medium which is mounted on the mounting portion before the jam occurs is deformed greatly. Meanwhile, a time taken for the medium to be reliably transported to the mounting portion after the suppressing unit is driven also needs to be considered. Accordingly, when the suppressing unit is deactivated in a case where the jam is fixed is important.

Therefore, in the above-described configuration, when it is detected that a medium transported after the jam is fixed can be transported to the mounting portion, the suppressing unit is deactivated on the basis of the result of detection performed by the detecting unit that is disposed in the transportation path on the upstream side of the suppressing unit and is closest to the suppressing unit. That is, it is possible to drive the suppressing unit for as long time as possible during a period between when the jam is fixed and when the medium is mounted on the mounting portion. Accordingly, it is possible to suppress the deformation of the medium after the jam is fixed.

Application Example 14

According to this application example, there is provided a printing system including a printing device that ejects liquid to form an image on a medium, and a post processing device that includes a mounting portion on which the medium, on which the image has been formed, is temporarily mounted, a post processing unit which performs post processing on the medium mounted on the mounting portion, and a suppressing unit which suppresses deformation of the medium mounted on the mounting portion.

According to this configuration, in a case where the medium, on which liquid has been ejected and an image has been formed in the printing device, is mounted on the mounting portion, the suppressing unit suppresses deformation such as the curling of the medium. Accordingly, it is possible to suppress misalignment of mediums, transportation failure, or the like.

Application Example 15

According to this application example, there is provided a printing system including a printing device that ejects liquid to form an image on a medium, a post processing device that includes a mounting portion on which the medium, on which the image has been formed, is temporarily mounted, a post processing unit which performs post processing on the medium mounted on the mounting portion, and a suppressing unit which suppresses deformation of the medium mounted on the mounting portion, and an intermediate transportation device that transports the medium, on which the image has been formed in a printing device, to the post processing device.

According to this configuration, the medium, on which liquid has been ejected and an image has been formed in the printing device, is transported to the post processing device via the intermediate transportation device. In a case where the medium on which the image has been formed is mounted on the mounting portion, the suppressing unit suppresses deformation such as the curling of the medium. Accordingly, it is possible to suppress misalignment of mediums, transportation failure, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to drawings. Note that, in the following drawings, the scale of each member and the like is different from the actual scale so that each member and the like becomes recognizable.

Configuration of Printing System

Figure 1:
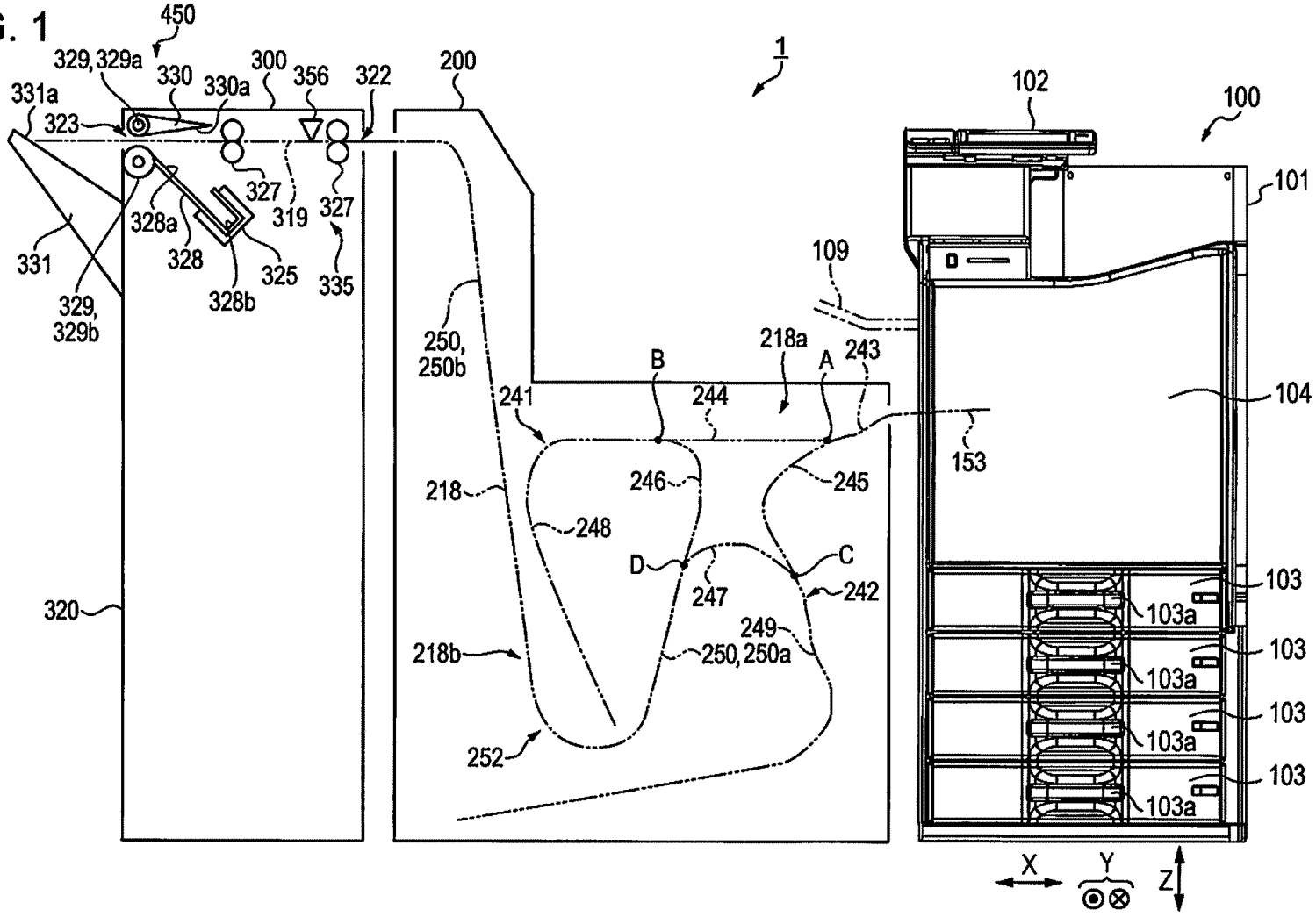
FIG. 1 is a schematic view illustrating a configuration of a printing system.
Figure 2:
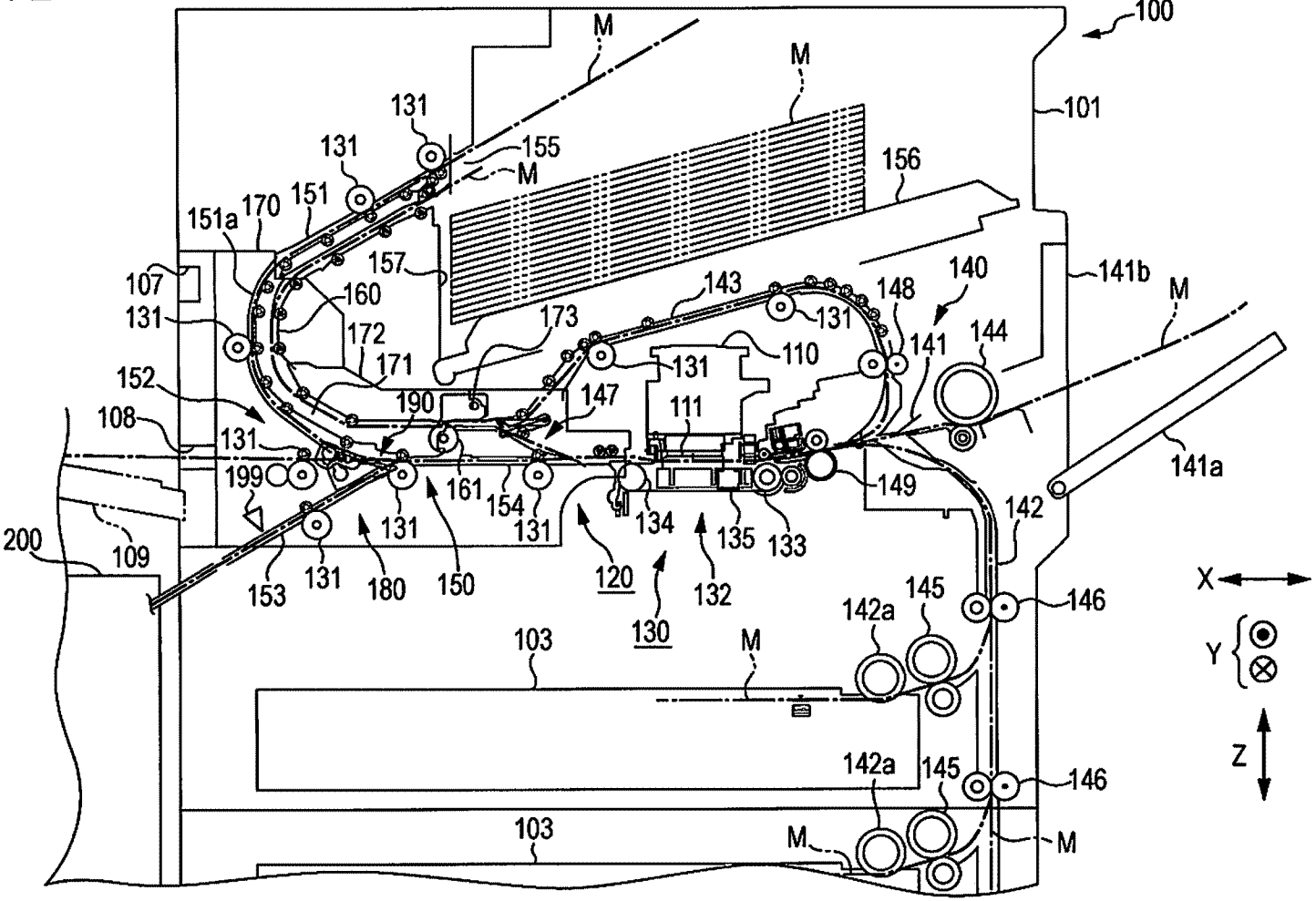
FIG. 2 is a configuration view illustrating a configuration of a printing device.
Figure 3:
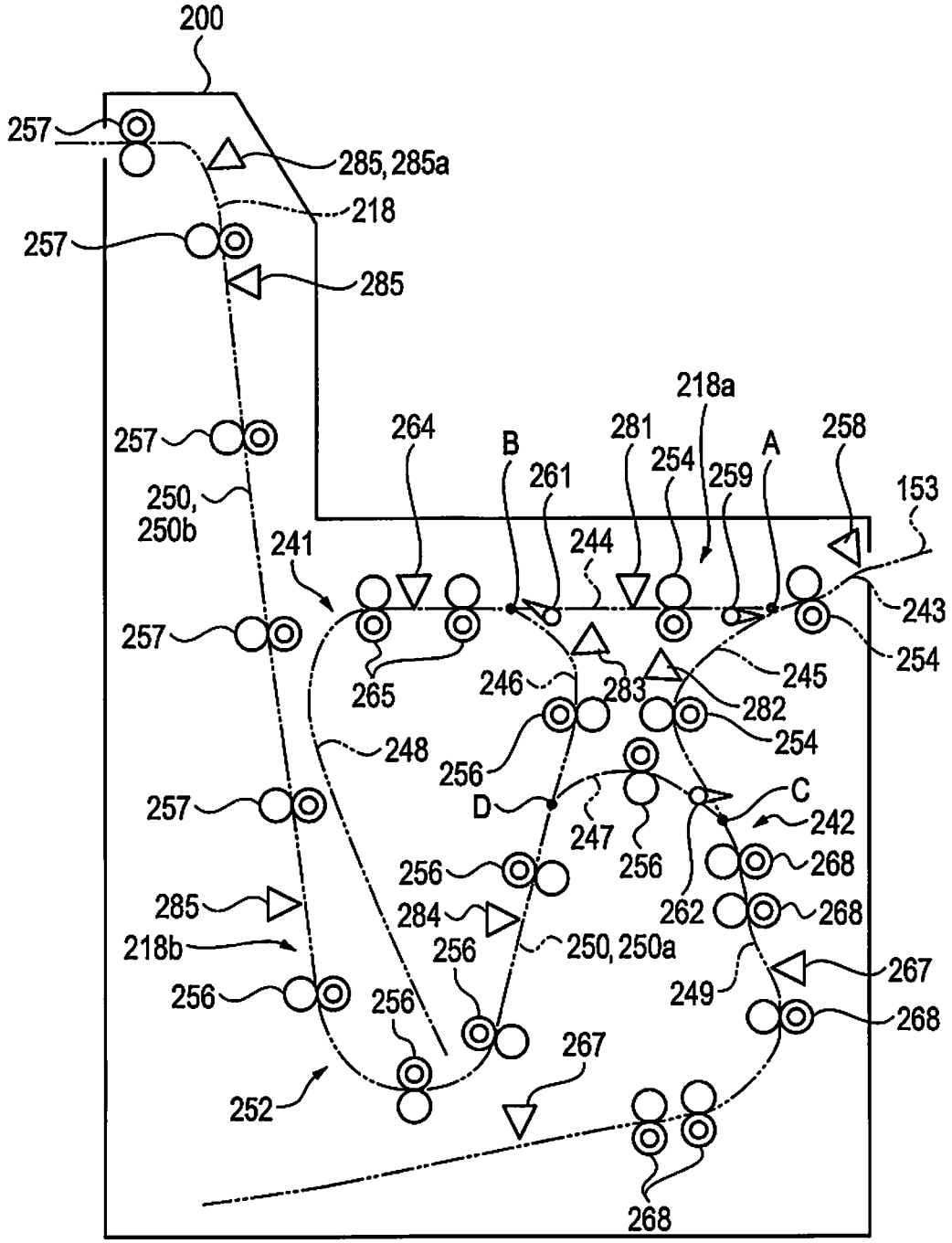
FIG. 3 is a configuration view illustrating a configuration of an intermediate transportation device.

First, a configuration of a printing system will be described. FIG. 1 is a schematic view illustrating a configuration of the printing system, FIG. 2 is a configuration view illustrating a configuration of a printing device, and FIG. 3 is a configuration view illustrating a configuration of an intermediate transportation device. As illustrated in FIG. 1, a printing system 1 according to the embodiment includes a printing device 100, an intermediate transportation device 200, and a post processing device 300. In addition, the printing system 1 includes a controller 10 (refer to FIG. 13) that controls all of the mechanisms in the printing system 1. The printing device 100 is an apparatus that forms an image on a paper sheet M as a medium. The post processing device 300 is a device that performs post processing such as a stapling process of binding a plurality of paper sheets M, on each of which an image is printed, with a staple (needle), for example. In addition, the intermediate transportation device 200 is a device that transports the paper sheet M, on which an image is printed by the printing device 100, to the post processing device 300. The intermediate transportation device 200 is disposed between the printing device 100 and the post processing device 300.

In the printing system 1 according to the first embodiment, a third discharging path 153 of the printing device 100 which is an upstream side transportation path is connected to an intermediate transportation path 218 of the intermediate transportation device 200 and the intermediate transportation path 218 is connected to a downstream side transportation path 319 of the post processing device 300. In addition, the third discharging path 153, the intermediate transportation path 218, and the downstream side transportation path 319 constitute a transportation path (two-dotted line in FIG. 1) that extends from the printing device 100, which is on the upstream side in a transportation direction of the paper sheet M, to the post processing device 300 via the intermediate transportation device 200.

As illustrated in FIG. 1, the printing device 100 is an ink jet printer that records an image such as a character, a drawing, and a photograph by causing ink, which is an example of liquid, to adhere to a paper sheet M, which is an example of a medium. The printing device 100 includes a recording apparatus side housing 101 that has an approximately rectangular parallelepiped shape. An operation unit 102 for performing various operations of the printing device 100 is attached to an upper portion of the recording apparatus side housing 101.

In the printing device 100, paper sheet cassettes 103 are provided in an area from the central portion to the lower portion of the printing device 100 in a vertical direction Z. In the present embodiment, four paper sheet cassettes 103 are arranged in the vertical direction Z. In each of the paper sheet cassettes 103, the paper sheets M, on which the printing device 100 performs recording, are accommodated being in a stacked state. In addition, in each of the paper sheet cassettes 103, a grip portion 103*a* which a user can grip is formed. In addition, the paper sheet cassette 103 is configured to be capable of being detached from the recording apparatus side housing 101. Note that, paper sheets M accommodated in each paper sheet cassette 103 may be different in type and may be the same in type.

A rectangular front plate cover 104 is provided above the uppermost paper sheet cassette 103 in the vertical direction Z. The front plate cover 104 is provided to be capable of rotating with a long side adjacent to the paper sheet cassette 103 as a base end and the front plate cover 104 is configured to be capable of rotating between two positions of an opening position, at which a tip end that is opposite to the base end is separated from the printing device 100, and a closing position, at which the front plate cover 104 constitutes a portion of the recording apparatus side housing 101.

In addition, as illustrated in FIG. 2, a discharging port 108 through which the paper sheet M is discharged is formed in a portion of the recording apparatus side housing 101 which is on the intermediate transportation device 200 side. In addition, a discharging tray 109 that extends from the recording apparatus side housing 101 to the intermediate transportation device 200 side is provided below the discharging port 108 such that the discharging tray 109 can be attached as necessary. That is, the paper sheet M discharged through the discharging port 108 is mounted on the discharging tray 109. Note that, the discharging tray 109 is configured to be capable of being detached from the recording apparatus side housing 101 and is inclined such that the height thereof increases from the base end, which is connected to the recording apparatus side housing 101, toward a tip end, which is opposite to the base end (left-upward direction in FIG. 2).

As illustrated in FIG. 2, in the recording apparatus side housing 101 which is included in the printing device 100, a recording unit 110 which performs recording on the paper sheet M while being positioned above the paper sheet M in the vertical direction Z and a transportation unit 130 which transports the paper sheet M along an in-device transportation path 120 are provided. The in-device transportation path 120 is formed such that the paper sheet M is transported in a transportation direction which is a direction intersecting a width direction of the paper sheet M, the width direction being a direction parallel to a front-rear direction Y.

The recording unit 110 includes a line-head type recording head 111 which can eject ink over the entire area in the width direction of the paper sheet M at once. The recording unit 110 forms an image on the paper sheet M by causing ink ejected from the recording head 111 to adhere to a recording surface of the paper sheet M which faces the recording head 111 (surface on which image is printed).

The transportation unit 130 includes a plurality of pairs of transportation rollers 131, which are arranged along the in-device transportation path 120 and are driven by a transportation driving motor (not shown), and a belt transportation unit 132 which is provided immediately below the recording unit 110. That is, recording is performed with ink being ejected from the recording head 111 to the paper sheet M, which is in a state of being transported by the belt transportation unit 132.

The belt transportation unit 132 includes a driving roller 133 which is disposed on the upstream side of the recording head 111 in the transportation direction, a driven roller 134 which is disposed on the downstream side of the recording head 111 in the transportation direction, and an endless annular belt 135 which is suspended between the rollers 133 and 134. When the driving roller 133 rotates, the belt 135 rotates in a circumferential direction thereof and the paper sheet M is transported to the downstream side with the belt 135 rotating in the circumferential direction. That is, the outer circumferential surface of the belt 135 functions as a supporting surface which supports the paper sheet M on which recording is performed.

The in-device transportation path 120 includes a supply path 140 along which the paper sheet M is transported to the recording unit 110, a discharging path 150 along which the paper sheet M after recording on which recording has been performed by the recording unit 110 is transported, and a branch path 160 which branches off using a branch mechanism 147.

The supply path 140 includes a first supply path 141, a second supply path 142, and a third supply path 143. In the first supply path 141, the paper sheet M which is inserted through an insertion port 141*b*, which is exposed when a cover 141*a* provided on a right side surface of the recording apparatus side housing 101 is opened, is transported to the recording unit 110. That is, the paper sheet M which is inserted through the insertion port 141*b* is linearly transported to the recording unit 110 with rotation of a pair of first driving rollers 144.

In the second supply path 142, the paper sheets M which are accommodated in each of the paper sheet cassettes 103, which are provided in the lower portion of the recording apparatus side housing 101 in the vertical direction Z, are transported to the recording unit 110. That is, the uppermost paper sheet M of the paper sheets M, which are accommodated in the paper sheet cassettes 103 in a state of being stacked, is fed by a pickup roller 142*a* and is transported to the recording unit 110 with rotation of a pair of second driving rollers 146 while being inverted in the vertical direction Z after the paper sheets M are separated from each other by a pair of separating rollers 145 in a one-by-one manner.

In the third supply path 143, in the case of duplex printing in which images are recorded on both surfaces of the paper sheet M, the paper sheet M with one surface on which recording has been performed by the recording unit 110 is transported to the recording unit 110 again. That is, the branch path 160 which branches off from the discharging path 150 is provided on the downstream side of the recording unit 110 in the transportation direction. That is, when duplex printing is performed, the paper sheet M is transported to the branch path 160 with the branch mechanism 147 being operated, the branch mechanism 147 being provided in the middle of the discharging path 150. In addition, in the branch path 160, a pair of branch path rollers 161 which can be rotated forwards and backwards is provided on the downstream side of the branch mechanism 147.

When duplex printing is performed, the paper sheet M with one surface on which printing has been performed is once guided to the branch path 160 by the branch mechanism 147 and is transported to the downstream side in the branch path 160 by the pair of branch path rollers 161 rotating forwards. Thereafter, the paper sheet M which has been transported to the branch path 160 is reversely transported from the downstream side to the upstream side in the branch path 160 by the pair of branch path rollers 161 rotating backwards. That is, the transportation direction of the paper sheet M which is transported along the branch path 160 is reversed.

The paper sheet M which is reversely transported from the branch path 160 is transported to the third supply path 143 and is transported to the recording unit 110 by the plurality of pairs of transportation rollers 131. When the paper sheet M is transported along the third supply path 143, the paper sheet M is inverted such that a surface thereof on which printing has not been performed faces the recording unit 110 and the paper sheet M is transported to the recording unit 110 with rotation of a third pair of driving rollers 148. That is, the third supply path 143 functions as an inversion transportation path along which the paper sheet M is transported while being inverted in the vertical direction Z.

In the second supply path 142 and the third supply path 143 from among the supply paths 141, 142, and 143, the paper sheet M is transported to the recording unit 110 while being curved in the vertical direction Z. Meanwhile, in the first supply path 141, the paper sheet M is transported to the recording unit 110 while being curved more slightly than in the second supply path 142 and the third supply path 143.

The leading end of the paper sheet M which is transported along the supply paths 141, 142, and 143 comes into contact with a pair of alignment rollers 149 of which rotation has been stopped after being transported to the pair of alignment rollers 149, which is provided on the upstream side of the recording unit 110 in the transportation direction. Then, an inclination of the paper sheet M with respect to the transportation direction is corrected (skew correction) in a state where the paper sheet M is in contact with the pair of alignment rollers 149. Thereafter, with rotation of the pair of alignment rollers 149, the paper sheet M of which the inclination has been corrected is transported to the recording unit 110 in a state of being aligned.

The paper sheet M with one surface or both surfaces on which recording has been performed by the recording unit 110 and the recording is finished is transported by the pairs of transportation rollers 131 along the discharging path 150 which constitutes a downstream side portion of the in-device transportation path 120. The discharging path 150 branches into a first discharging path 151, a second discharging path 152, and the third discharging path 153 at a position on the downstream side of a position at which the branch path 160 branches off from the discharging path 150. That is, after being transported along a common discharging path (upstream side discharging path) 154 which constitutes an upstream side portion of the discharging path 150, the paper sheet M on which recording is finished is guided by a guiding mechanism (switch guiding unit) 180 to any one of the first to third discharging paths 151, 152, and 153 which constitute the downstream side portion of the discharging path 150. The guiding mechanism 180 is provided at a downstream end of the common discharging path 154.

The first discharging path (upper discharging path) 151 is provided to extend to an upper portion of the recording apparatus side housing 101 and to extend being curved along the branch path 160. The paper sheet M which is transported along the first discharging path 151 is discharged via a discharging port 155 which opens at a portion of the recording apparatus side housing 101 so as to function as a terminal end of the first discharging path 151. In addition, the paper sheets M which are discharged through the discharging port 155 fall downward in the vertical direction Z and are discharged to a mounting table 156 in a state of being stacked as illustrated by two-dotted lines in FIG. 2. Note that, the paper sheet M is discharged by the plurality of pairs of transportation rollers 131, which are disposed in the discharging path 150, to the mounting table 156 through the discharging port 155 in such a posture that the recording surface at the time of simplex printing faces downward in the vertical direction Z.

The mounting table 156 has a tip end-rising inclined shape in which the height in the vertical direction Z increases toward the right side in a transverse direction X, and the paper sheets M are mounted on the mounting table 156 in a state of being stacked. At this time, the paper sheets M mounted on the mounting table 156 move to the left side along a slope of the mounting table 156 and are mounted being close to a vertical side wall 157 which is provided below the discharging port 155 of the recording apparatus side housing 101.

In addition, the first discharging path 151 includes a curved inversion path 151*a* in which the paper sheet M on which recording has been performed by the recording unit 110 is inverted upside down when the paper sheet M is transported to the discharging port 155. That is, in the curved inversion path 151*a*, the paper sheet M on which recording has been performed by the recording unit 110 is curved with the recording surface disposed on the inner side and the paper sheet M is inverted so that a state where the recording surface of the paper sheet M faces upward in the vertical direction Z changes to a state where the recording surface faces downward in the vertical direction Z. Therefore, in the discharging path 150, the paper sheet M passes through the curved inversion path 151*a* so that the paper sheet M is discharged through the discharging port 155 in a state where the recording surface at the time of simplex printing faces the mounting table 156.

The second discharging path 152 branches toward a lower position in the vertical direction Z than the first discharging path 151 and extends linearly (horizontally) from the recording unit 110 to the intermediate transportation device 200. Therefore, the paper sheet M which is transported along the second discharging path 152 is not transported being curved as in the case of the first discharging path 151 and is discharged toward the discharging tray 109 through the discharging port 108 after being linearly transported in the same posture as when passing through the recording unit 110 with the posture thereof being maintained constant. That is, the second discharging path 152 functions as a non-inversion discharging path along which the paper sheet M is transported to the discharging tray 109 with the paper sheet M being not inverted.

The third discharging path 153 branches to a lower position in the vertical direction Z than the second discharging path 152 and obliquely extends downward in the vertical direction Z such that the third discharging path 153 extends toward a lower portion of the recording apparatus side housing 101. In addition, the downstream end of the third discharging path 153 is connected to the intermediate transportation path 218 included in the intermediate transportation device 200. That is, the paper sheet M which is transported along the third discharging path 153 is discharged to the intermediate transportation device 200. Note that, the third discharging path 153 is provided with a transportation detecting unit 199 which can detect presence or absence of the paper sheet M. The transportation detecting unit 199 is a light transmitting photo interrupter or a light reflecting photo interrupter and includes a light emitting unit which emits light and a light receiving unit which receives light emitted from the light emitting unit. As a light emitting element in the light emitting unit, a light emitting diode (LED), a laser light emitting element, or the like is used. In addition, the light receiving unit is constituted by a photo transistor, a photo IC, or the like. With the light emitting unit and the light receiving unit, it is possible to detect presence or absence of the paper sheet M (whether the light receiving unit receives light or not).

The transportation detecting unit 199 is connected to the controller 10 (refer to FIG. 13) and is controlled on the basis of a predetermined program. The controller 10 drives the transportation detecting unit 199 and presence or absence of the paper sheet M is detected through comparison between a light receiving amount of the light receiving unit and a predetermined threshold value. In a case where presence and absence of the paper sheet M are repeatedly detected in synchronization with the driving of the pair of transportation rollers 131, it is determined that the paper sheet M is in a state of being transported normally. On the other hand, in a case where the light receiving amount of the light receiving unit does not change at a predetermined time point or for a predetermined time period, it is determined that the paper sheet M is in an abnormal state (jammed state). For example, in a case where the paper sheet M is not transported normally from the recording head 111 side due to transportation failure of the paper sheet M, it is determined that the paper sheet M is in an abnormal state (jammed state).

A portion of the discharging path 150 and a portion of the branch path 160 are attached to a drawer unit 170 which is provided in the recording apparatus side housing 101. Note that, the drawer unit 170 is configured to be capable of being detached from the recording apparatus side housing 101.

Here, it is preferable that the paper sheet M which can be used in the printing system 1 be a hygroscopic and flexible paper sheet. Examples thereof include a plain paper sheet such as an electrophotographic copying paper sheet, an ink jet paper sheet with a water-soluble ink absorbing layer containing silica, alumina, polyvinyl alcohol (PVA), and polyvinyl pyrrolidone (PVP), and the like. In addition, examples of a type of absorptive recording medium having a relatively small water-soluble ink penetration rate include an art paper sheet, a coated paper sheet, a cast paper sheet, and the like which are used for general offset printing.

Note that, in the present embodiment, the "paper sheet M" means a paper sheet defined in No. 6139 of JIS-P-0001, of which the main material is pulp (main component is cellulose) and which is used in a printer or the like. Specific examples thereof include a high quality paper sheet, a PPC copy paper sheet, an uncoated printing paper sheet, and the like. As the paper sheet M, a commercially available paper sheet can be used and examples thereof include various paper sheets such as Xerox 4200 (manufactured by Fuji Xerox Co., Ltd.) and GeoCycle (manufactured by Gerogia-Pacific Corporation). In addition, the basis weight of the paper sheet M is preferably 60 to 120 g/m$^2$.

Ink Composition

Next, an ink composition which is used in the printing system 1 (printing device 100) according to the present embodiment will be described.

It is preferable that the ink composition according to the present embodiment contain at least one kind of compound selected from the group consisting of (A), (B), and (C) which will be described later. In addition, it is preferable that the ink be an aqueous ink composition, in which the main solvent of ink is water, in view of safety, a handling property, and various performances (color developing property, strike-through suitability, ink reliability, and the like) and it is preferable to use pure water or ultrapure water such as ion exchanged water, ultra-filtered water, reverse osmosis water, distilled water or the like as the water. Particularly, it is preferable to use water sterilized through ultraviolet irradiation or addition of hydrogen peroxide in view of preventing mold and bacteria from being generated so that ink can be preserved for a long period of time. It is preferable that the ink composition contain 10% by mass to 60% by mass of water in view of securing appropriate physical property values (viscosity and the like) of ink and securing stability and reliability of ink.

Since the amount of water contained in the ink composition is defined to fall within the above-described range, the amount of moisture absorbed by cellulose in the paper sheet M becomes smaller than that in the case of an ink composition according to the related art. As a result, it is possible to suppress swelling of the cellulose which is considered as the reason of the cockling or curling of the paper sheet. Hereinafter, properties suitable for suppressing cockling or curling of the paper sheet will be referred to as "cockling suitability" and "curling suitability" also, respectively.

In a case where the amount of moisture contained is smaller than 10% by mass, the fixation properties with respect to a recording medium (paper sheet M) may be lowered. Meanwhile, in a case where the amount of moisture contained exceeds 60% by mass, as with the aqueous ink composition in the related art, the cockling or curling of the paper sheet is likely to occur when printing is performed on a recording medium including an absorbing layer of a paper supporting body with a low ink absorbing property.

The viscosity of the ink in a temperature range of 10° C. to 40° C. is influenced by the temperature characteristics of a coloring agent, a moisturizing agent, and a solvent contained in the ink. Among those described above, the influence of the moisturizing agent is particularly large, and the viscosity at 10° C. is likely to increase and the viscosity at 40° C. is likely to decrease depending on the type of the moisturizing agent, the amount of the moisturizing agent added, and the content ratio of the moisturizing agent. In the specification, a temperature-related viscosity characteristic of the ink being excellent means a small difference in viscosity at 10° C. to 40° C.

It is preferable that the ink composition according to the present embodiment contain at least one kind of compound selected from the group consisting of (A), (B), and (C), which will be described later, in view of appropriately maintaining a balance among curling suitability, cockling suitability, strike-through suitability, clogging suitability, and the temperature-related viscosity characteristic of the ink. The above-described compounds function as the moisturizing agent also. Here, the compound of (A) is at least one kind of compound selected from the group consisting of glycerin, 1,2,6-hexanetriol, diethylene glycol, triethylene glycol, tetraethylene glycol, dipropylene glycol, the compound of (B) is at least one kind of compound selected from the group consisting of trimethylol propane and trimethylol ethane, and the compound of (C) is at least one kind of compound selected from the group consisting of betaines, saccharides and ureas, of which the molecular weight falls within a range of 100 to 200.

The compound of (A) is a substance that is particularly effective for clogging suppression and is also effective for curling suppression and cockling suppression. However, since the substance has an excellent penetrating ability with respect to the recording medium, the substance is inferior in strike-through suitability. In view of effectively and reliably achieving the above-described effects, it is preferable to use glycerin or triethylene glycol as the compound of (A).

The compound of (B) is a substance that is particularly effective for clogging suppression and is excellent in strike-through suitability since the substance has a penetration suppressing effect. In view of effectively and reliably achieving the above-described effects, it is preferable to use trimethylol propane as the compound of (B).

Since the compounds of (A) and (B) have a characteristic that the difference in viscosity at 10° C. to 40° C. of the substance is great, when the amount of the compounds of (A) and (B) contained in the ink composition is increased, the temperature-related viscosity characteristic is greatly influenced and the difference in viscosity at 10° C. to 40° C. of the ink composition is increased.

The compound of (C) is a substance that is particularly excellent in curling suitability and cockling suitability. In addition, this compound is a substance that is excellent in temperature-related viscosity characteristic. Specific examples of the compound of (C) include betaines, which are N-trialkyl substitution products of amino acids, such as glycine betaine (molecular weight: 117 (also called "trimethylglycine")), γ-butyrobetaine (molecular weight: 145), homarine (molecular weight: 137), trigonelline (molecular weight: 137), carnitine (molecular weight: 161), homoserine betaine (molecular weight: 161), valine betaine (molecular weight: 159), lysine betaine (molecular weight: 188), ornithine betaine (molecular weight: 176), alanine betaine (molecular weight: 117), stachydrine (molecular weight: 185), and glutamic acid betaine (molecular weight: 189), saccharides such as glucose (molecular weight: 180), mannose (molecular weight: 180), fructose (molecular weight: 180), ribose (molecular weight: 150), xylose (molecular weight: 150), arabinose (molecular weight: 150), galactose (molecular weight: 180), and sorbitol (molecular weight: 182); and ureas such as allyl urea (molecular weight: 100), N,N-dimethylol urea (molecular weight: 120), malonyl urea (molecular weight: 128), carbamyl urea (molecular weight: 103), 1,1-diethyl urea (molecular weight: 116), n-butyl urea (molecular weight: 116), creatinine (molecular weight: 113), and benzyl urea (molecular weight: 150). In addition, if the molecular weight of the compound of (C) is less than 100, the difference in viscosity at 10° C. to 40° C. is more likely to increase. Meanwhile, if the molecular weight of the compound of (C) is equal to or greater than 200, the viscosity of the ink composition is likely to increase with respect to the amount of the compound added in the ink composition. Therefore, it is preferable that the molecular weight of the compound of (C) fall within a range of 100 to 200. Among these, saccharides and betaines are preferable and betaines are more preferable since the effect of suppressing the curling of the paper sheet is particularly high. From the same viewpoint, glycine betaine is more preferable as betaines, sorbitol is more preferable as saccharides, and among these, glycine betaine is particularly preferable. As glycine betaine, for example, a commercially available product such as amino coat (manufactured by Asahi Kasei Chemicals Corporation) can be used.

In view of curling suitability, cockling suitability, strike-through suitability, and clogging suitability, it is preferable that the amount of compounds of (A), (B), and (C) contained in the ink composition be 10% by mass to 40% by mass in total.

In addition, in view of exhibiting the above-described effects of the compounds with good balance, the mass ratio of the contents of the compounds is preferably (A):(B):(C)=(1.0):(0.1 to 1.0):(1.0 to 3.5). If the mass ratio of the compound of (B) to the compound selected from the group of (A) (also referred to as compound of (A) (same applies hereinafter)) is greater than that described above, the curling suitability and cockling suitability are lowered and if the mass ratio of the compound of (B) to the compound selected from the group of (A) (also referred to as compound of (A) (same applies hereinafter)) is smaller than that described above, the strike-through suitability is lowered. If the mass ratio of the compound of (C) to the compound of (A) is greater than that described above, the clogging suitability is lowered and if the mass ratio of the compound of (C) to the compound of (A) is smaller than that described above, the curling suitability and cockling suitability are lowered.

In addition, it is preferable that the ink composition according to the present embodiment contain a water-soluble organic solvent for the purpose of preventing clogging in the vicinity of a nozzle of an ink jet head, appropriately controlling the penetrating ability with respect to the recording medium of ink or bleeding of ink, and giving drying properties to ink. From the above-described viewpoint, it is preferable that the water-soluble organic solvent include 1,2-alkanediol and/or glycol ether. Specific examples of 1,2-alkanediol include 1,2-octanediol, 1,2-hexanediol, 1,2-pentanediol, and 4-methyl-1,2-pentanediol. In addition, specific examples of glycol ether include ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, triethylene glycol mono-n-butyl ether, 1-methyl-1-methoxy butanol, propylene glycol monomethyl ether, propylene glycol monoethyl ether, propylene glycol mono-t-butyl ether, propylene glycol mono-n-propyl ether, propylene glycol mono-iso-propyl ether, dipropylene glycol monomethyl ether, dipropylene glycol monoethyl ether, dipropylene glycol mono-n-propyl ether, and dipropylene glycol mono-iso-propyl ether. In addition to the above-described examples, 2-pyrrolidone, N-methyl-2-pyrrolidone and the like can also be used as the water-soluble organic solvent. One or more kinds of these water-soluble organic solvents can be used and it is preferable that the ink composition contain 1% by mass to 50% by mass of water-soluble organic solvent in view of securing appropriate physical property values (viscosity and the like) of ink and securing printing quality and reliability.

Furthermore, in order to suppress a wetting property of the ink with respect to the recording medium and to achieve the penetrating ability with respect to the recording medium and the text printing stability in an ink jet recording method, it is preferable that the ink composition contain a surface tension conditioner. As the surface tension conditioner, an acetylene glycol based surfactant and polyether-modified siloxanes are preferable. Examples of the acetylene glycol based surfactant include Surfynol 420, 440, 465, 485, 104, and STG (product names, manufactured by Air Products and Chemicals, Inc.), Olfine PD-001, SPC, El004, and El010 (product names, manufactured by Nissin Chemical Co., Ltd.), and Acetylenol E00, Acetylenol E40, Acetylenol E100, and Acetylenol LH (product names, manufactured by Kawaken Fine Chemicals Co., Ltd.). In addition, examples of and polyether-modified siloxanes include BYK-346, 347, 348, and UV3530 (manufactured by BYK Co., Ltd.) One or more kinds of the above-described substances can be used in the ink composition and is contained such that the surface tension of the ink composition is adjusted to preferably 20 mN/m to 40 mN/m and preferably 0.1% by mass to 3.0% by mass of surface tension conditioner is contained in the ink composition.

In addition, a pH conditioner, a complexing agent, an antifoaming agent, an antioxidant, an ultraviolet absorbing agent, an antiseptic and antifungal agent, and the like may be added to the ink composition as necessary. As the pH conditioner, for example, alkali hydroxide such as lithium hydroxide, potassium hydroxide, and sodium hydroxide, ammonia, and an alkanolamine such as triethanolamine, tripropanolamine, diethanolamine, monoethanolamine or the like can be used. Particularly, it is preferable that at least one kind of pH conditioner selected from alkali metal hydroxide, ammonia, triethanolamine, and tripropanolamine be contained in the ink composition so that pH is adjusted to 6 to 10. If pH falls outside this range, there is an adverse effect on the materials or the like constituting the ink jet printer and clogging recovering properties deteriorate.

It is preferable that the ink composition according to the present embodiment contain a pigment in the purpose of image formation and text printing. Any of known inorganic pigments and organic pigments can be used as the pigment used in the ink composition according to the present embodiment. Examples of such a pigment include, for example, a phthalocyanine-based pigment, an azo-based pigment, an anthraquinone-based pigment, an azomethine-based pigment, and a condensed ring pigment in addition to pigments listed in the Color Index such as Pigment Yellow, Pigment Red, Pigment Violet, Pigment Blue, Pigment Black, and the like. In addition, examples of such a pigment include organic pigments such as Yellow No. 4, Yellow No. 5, Yellow No. 205, Yellow No. 401, Orange No. 228, Orange No. 405, Blue No. 1, Blue No. 404, and the like and inorganic pigments such as carbon black, titanium oxide, zinc oxide, zirconium oxide, iron oxide, ultramarine blue, iron blue, chromium oxide and the like. Examples of the colour index of the pigment include, for example, C.I Pigments Yellow 1, 3, 12, 13, 14, 17, 24, 34, 35, 37, 42, 53, 55, 74, 81, 83, 95, 97, 98, 100, 101, 104, 108, 109, 110, 117, 120, 128, 138, 150, 153, 155, 174, 180, and 198, C.I Pigments Red 1, 3, 5, 8, 9, 16, 17, 19, 22, 38, 57:1, 90, 112, 122, 123, 127, 146, 184, and 202, C.I Pigments Violet 1, 3, 5:1, 16, 19, 23, and 38, C.I Pigments Blue 1, 2, 15, 15:1, 15:2, 15:3, 15:4, and 16, and C.I Pigments Black 1 and 7 and one or more kinds of pigments may be contained in the ink composition.

The pigments used in the present embodiment may be resin dispersion type pigments. It is preferable that such a pigment be blended into the ink composition as a pigment dispersion, which is obtained by dispersing the pigment in an aqueous medium along with a dispersant such as a polymeric dispersant or a surfactant by using a ball mill, a roll mill, a bead mill, a high-pressure homogenizer, a high-speed stirring type dispersing machine, or the like, or as a pigment dispersion, which is obtained by dispersing the pigment in the aqueous medium after the pigment is processed as a self-dispersion type pigment that is obtained by bonding a dispersibility-imparting group (hydrophilic functional group and/or salt thereof) to a surface of a pigment directly or indirectly via an alkyl group, an alkyl ether group, an aryl group, or the like and that is dispersed and/or dissolved in the aqueous medium without a dispersant.

Examples of the dispersant include natural polymer compounds such as glue, gelatin, and saponin, and synthetic high polymers such as polyvinyl alcohols, polypyrrolidones, and resins such as acrylic resins (such as polyacrylic acid, acrylic acid-acrylonitrile copolymer, vinyl acetate-acrylic acid copolymer, vinyl acetate-acrylic acid ester copolymer, and like), styrene-acrylic resins (styrene-acrylic acid copolymer, styrene-methacrylic acid copolymer, styrene-methacrylic acid-acrylic acid alkyl ester copolymer, styrene-α-methylstyrene-acrylic acid copolymer, styrene-α-methylstyrene-acrylic acid-acrylic acid alkyl ester copolymer, styrene-vinyl acetate-acrylic acid copolymer, and like), styrene-maleic acid resins, and a vinylacetate-fatty acid vinyl ethylene copolymer and the salt thereof. The configuration of the copolymer may be any of the random type, the block type, and the graft type.

In addition, examples of the surfactant which is used as the dispersant include anionic surfactants such as fatty acid salts, higher alkyl dicarboxylic acid salts, higher alcohol sulfuric acid ester salts and higher alkyl sulfonic acid salts, cationic surfactants such as fatty acid amine salts and fatty acid ammonium salts, and nonionic surfactants such as polyoxyalkyl ethers, polyoxyalkyl esters, and sorbitan alkyl esters.

Among these dispersants, a water-insoluble resin is particularly preferable. Specifically, as the water-insoluble resin, a resin, which is constituted of a block copolymer resin of a monomer including a hydrophobic group and a monomer including a hydrophilic group, contains a monomer including at least a salt-forming group, and of which the solubility with respect to 100 g of water at 25° C. after neutralization is less than 1 g, is preferable. Examples of the monomer including the hydrophobic group include methacrylic acid esters such as methyl methacrylate, ethyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, octyl methacrylate, decyl methacrylate, dodecyl methacrylate, octadecyl methacrylate, cyclohexyl methacrylate, phenyl methacrylate, benzyl methacrylate, and glycidyl methacrylate, vinyl esters such as vinyl acetate; vinyl cyanide compounds such as acrylonitrile and methacrylonitrile, and aromatic vinyl monomers such as styrene, α-methylstyrene, vinyl toluene, 4-t-butylstyrene, chlorostyrene, vinylanisole, and vinylnaphthalene. These can be used alone or as a mixture of two or more.

Examples of the monomer including a hydrophilic group include polyethylene glycol monomethacrylate, polypropylene glycol monomethacrylate, and ethylene glycol/propylene glycol monomethacrylate. These can be used alone or as a mixture of two or more. Examples of the monomer having a salt-forming group include acrylic acid, methacrylic acid, styrenecarboxylic acid, and maleic acid. These can be used alone or as a mixture of two or more. Furthermore, macromonomers such as styrene macromonomers and silicone macromonomers each having a polymerizable functional group at one end and other monomers can be used.

The water-insoluble resin is preferably used as a salt neutralized by using a tertiary amine such as ethylamine, and trimethylamine, and an alkali neutralizing agent such as lithium hydroxide, sodium hydroxide, potassium hydroxide, and ammonia, and a water-insoluble resin having a weight-average molecular weight of 10000 to 150000 is preferable in view of stably dispersing the pigment.

The self-dispersion type pigment which can be dispersed and/or dissolved in water without a dispersant is prepared by, for example, bonding (grafting) a dispersibility-imparting group or active species including the dispersibility-imparting group to a surface of pigment through a physical or chemical treatment with respect to the pigment. Examples of the physical treatment include a vacuum plasma treatment. In addition, examples of the chemical treatment include a wet oxidation method of oxidizing a surface of a pigment in water by using an oxidizing agent and a method of bonding a carboxyl group via a phenyl group by bonding p-aminobenzoic acid to the surface of the pigment. Since the ink composition containing the self-dispersion type pigment does not need to contain the above-described dispersant that is contained in order to disperse a conventional pigment, foam, which is generated due to a decrease in defoaming property caused by the dispsersant, is barely generated and thus it is easy to prepare ink excellent in ejection stability. In addition, since a large increase in viscosity caused by the dispersant is suppressed, it is possible to contain a larger amount of pigment and thus it is possible to sufficiently improve the printing density or to handle the ink composition with ease. Due to these advantages, the self-dispersion type pigment is effective for a black ink composition which needs a particularly high concentration and it is preferable that the black ink composition, which is used as the ink composition in the present embodiment, contain at least the self-dispersion type pigment which can be dispersed and/or dissolved in water without the dispersant.

In the present embodiment, the self-dispersion type pigment which is subject to a surface treatment through an oxidation treatment using hypohalous acid and/or a salt of hypohalous acid or an oxidation treatment using ozone is preferable in terms of high coloring properties. In addition, a commercially available product can be used as the self-dispersion type pigment and examples of the commercially available product include Microjet CW-1 (product name, manufactured by Orient Chemical Industries Co., Ltd.), and CAB-O-JET200 and CAB-O-JET300 (product name, manufactured by Cabot Corporation).

In addition, it is preferable that these pigments in ink have a volume-average particle diameter in the range of 50 nm to 200 nm in terms of storage stability of the ink and prevention of nozzle clogging. The volume-average particle diameter can be obtained through particle size measurement using, for example, Microtrac UPA 150 (manufactured by Microtrac, Inc.) or a particle size distribution analyzer LPA3100 (manufactured by OTSUKA ELECTRONICS CO., LTD.).

Such a pigment is preferably contained in the ink composition in a range of 6% or more by mass.

When the content of the pigment is less than 6% by mass, the printing density (color development properties) may be insufficient. In addition, although the upper limit of the content of the pigment is not particularly limited, the content may be equal to or smaller than 25% by mass. When the content of the pigment is greater than 25% by mass, defects in reliability such as nozzle clogging and discharging instability may occur.

The ink composition according to the present embodiment preferably contains a resin emulsion in view of ensuring fixation properties with respect to the recording medium. The resin emulsion preferably contains resin particles having a lowest film-forming temperature of lower than 20° C. Since a resin emulsion containing resin particles that have a lowest film-forming temperature of lower than 20° C. is used as the resin emulsion and the resin particles form a film at a usage environment ambient temperature which is usually 20° C. or higher, the fixation properties with respect to the recording medium and abrasion resistance of the ink composition are improved.

Here, the lowest film-forming temperature is measured as follows. First, 0.3 mm of resin emulsion is applied to a stainless plate of a temperature gradient test device. Immediately after the application, a basket containing silica gel is placed on the plate and is covered with a transparent plastic cover. After a coating film is dried, the temperature of a boundary between an even continuous film portion and a white cloudy portion is obtained and is used as the lowest film-forming temperature.

The resin emulsion preferably contains one or more kinds of resin particles selected from the group consisting of acrylic resins, methacrylic resins, vinyl acetate resins, vinyl chloride resins, and styrene-acrylic resins. These resins may be used as a homopolymer or a copolymer and may have a monophase structure or a multiphase structure (core-shell type).

Furthermore, at least any of these resin emulsions contained in the ink composition used in the present embodiment is preferably blended in the ink composition in a form of emulsion of resin particles obtained by emulsion polymerization of an unsaturated monomer. Even if the resin particles are added to the ink composition alone, dispersion of the resin particles may be insufficient. Therefore, the resin fine particles in an emulsion form are preferable in view of manufacturing the ink composition. In addition, the emulsion is preferably an acrylic emulsion in terms of storage stability of the ink composition.

The emulsion of the resin particles (for example, acrylic emulsion) can be formed by a known emulsion polymerization method. For example, the emulsion can be obtained by emulsion-polymerizing an unsaturated monomer (for example, unsaturated vinyl monomer) in water in the presence of a polymerization initiator and a surfactant.

Examples of the unsaturated monomer include acrylic acid ester monomers, methacrylic acid ester monomers, aromatic vinyl monomers, vinyl ester monomers, vinyl cyanide compound monomers, halogenated monomers, olefin monomers, and diene monomers which are usually used in emulsion polymerization.

Further specific examples of the unsaturated monomer include acrylic acid esters such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, octyl acrylate, decyl acrylate, dodecyl acrylate, octadecyl acrylate, cyclohexyl acrylate, phenyl acrylate, benzyl acrylate, and glycidyl acrylate; methacrylic acid esters such as methyl methacrylate, ethyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, octyl methacrylate, decyl methacrylate, dodecyl methacrylate, octadecyl methacrylate, cyclohexyl methacrylate, phenyl methacrylate, benzyl methacrylate, and glycidyl methacrylate; vinyl esters such as vinyl acetate; vinyl cyanide compounds such as acrylonitrile and methacrylonitrile; halogenated monomers such as vinylidene chloride and vinyl chloride; aromatic vinyl monomers such as styrene, α-methylstyrene, vinyl toluene, 4-t-butylstyrene, chlorostyrene, vinylanisole, and vinylnaphthalene; olefins such as ethylene and propylene; dienes such as butadiene and chloroprene; vinyl monomers such as vinyl ether, vinyl ketone, and vinyl pyrrolidone; unsaturated carboxylic acids such as acrylic acid, methacrylic acid, itaconic acid, fumaric acid, and maleic acid; acrylamides such as acrylamide, methacrylamide, N,N'-dimethyl acrylamide; hydroxyl group-containing monomers such as 2-hydroxyethyl acrylate, 2-hydroxypropyl acrylate, 2-hydroxyethyl methacrylate, and 2-hydroxypropyl methacrylate. These can be used alone or in a mixture of two or more.

In addition, a cross-linkable monomer having two or more polymerizable double bonds can be used as the unsaturated monomer. Examples of the cross-linkable monomer having two or more polymerizable double bonds include diacrylate compounds such as polyethylene glycol diacrylate, triethylene glycol diacrylate, 1,3-butylene glycol diacrylate, 1,4-butylene glycol diacrylate, 1,6-hexanediol diacrylate, neopentyl glycol diacrylate, 1,9-nonanediol diacrylate, polypropylene glycol diacrylate, 2,2'-bis(4-acryloxypropyloxyphenyl)propane, and 2,2'-bis(4-acryloxydiethoxyphenyl)propane; triacrylate compounds such as trimethylol propane triacrylate, trimethylol ethane triacrylate, and tetramethylolmethane triacrylate; tetraacrylate compounds such as ditrimethylol tetraacrylate, tetramethylolmethane tetraacrylate, and pentaerythritol tetraacrylate; hexaacrylate compounds such as dipentaerythritol hexaacrylate; dimethacrylate compounds such as ethylene glycol dimethacrylate, diethylene glycol dimethacrylate, triethylene glycol dimethacrylate, polyethylene glycol dimethacrylate, 1,3-butylene glycol dimethacrylate, 1,4-butylene glycol dimethacrylate, 1,6-hexanediol dimethacrylate, neopentyl glycol dimethacrylate, dipropylene glycol dimethacrylate, polypropylene glycol dimethacrylate, polybutylene glycol dimethacrylate, and 2,2'-bis(4-methacryloxydiethoxyphenyl)propane; trimethacrylate compounds such as trimethylol propane trimethacrylate and trimethylol ethane trimethacrylate; methylene bisacrylamide; and divinylbenzene. These can be used alone or in a mixture of two or more.

Furthermore, in addition to the polymerization initiator and the surfactant used in the emulsion polymerization, a chain transfer agent and also, for example, a neutralizer may be used according to a common method. Particularly, the neutralizer is preferably ammonia or an inorganic alkali hydroxide such as sodium hydroxide or potassium hydroxide.

In the present embodiment, the resin emulsion is preferably contained in the ink composition in the range of 1% by mass to 10% by mass in view of more effectively obtaining ink jet suitability physical values, reliability (such as clogging and ejection stability), and fixation properties of the ink composition.

The volume-average particle diameter of the resin emulsion contained in the ink composition is preferably 5 nm to 400 nm and is more preferably 50 nm to 200 nm in terms of dispersion stability of the resin particles in the ink composition and fixation properties. The volume-average particle diameter is measured by using COULTER COUNTER N4 (product name, manufactured by COULTER INC.).

Configuration of Intermediate Transportation Device

Next, the intermediate transportation device 200 will be described. As illustrated in FIG. 1, the intermediate transportation device 200 is provided with an intermediate transportation unit 252 which can transport the paper sheet M. The intermediate transportation unit 252 includes at least one inverting unit (in present embodiment, two inverting units of first inverting unit 241 and second inverting unit 242) that inverts the transported paper sheet M. The first inverting unit 241 and the second inverting unit 242 are positioned on the downstream side of the recording unit 110 in the transportation direction in the transportation path and invert the paper sheet M on which an image has been formed (printed). In addition, the intermediate transportation device 200 includes the intermediate transportation path 218 along which the paper sheet M is transported. Accordingly, the intermediate transportation device 200 has a drying function of drying the paper sheet M on which an image has been printed in the printing device 100 while transporting the paper sheet M and an inverting function of inverting the paper sheet M which is transported from the printing device 100.

The intermediate transportation path 218 of the intermediate transportation device 200 is connected to the third discharging path 153 of the printing device 100. In addition, the intermediate transportation path 218 includes an inlet path 243 of which the upstream end is connected to the third discharging path 153 and a first branch path 244 and a second branch path 245 which branch off at a branch point A which is the downstream end of the inlet path 243. That is, the downstream end of the inlet path 243, the upstream end of the first branch path 244, and the upstream end of the second branch path 245 are connected to the branch point A. In addition, the lengths of the first branch path 244 and the second branch path 245 in the transportation direction are substantially the same.

Furthermore, the intermediate transportation path 218 includes a first junction path 246 which is connected to a first connection point B which is the downstream end of the first branch path 244 and a second junction path 247 which is connected to a second connection point C which is the downstream end of the second branch path 245. The lengths of the first junction path 246 and the second junction path 247 in the transportation direction are substantially the same.

In addition, a first inversion path 248 which the first inverting unit 241 includes is connected to the first connection point B. In addition, a second inversion path 249 which the second inverting unit 242 includes is connected to the second connection point C. That is, the downstream end of the first branch path 244, the upstream end of the first junction path 246, and one end of the first inversion path 248 are connected to the first connection point B. In addition, the downstream end of the second branch path 245, the upstream end of the second junction path 247, and one end of the second inversion path 249 are connected to the second connection point C. Note that, the lengths of the first inversion path 248 and the second inversion path 249 in the transportation direction are equal to or greater than the maximum length of the paper sheet M on which an image can be formed (printed) in the printing device 100.

Furthermore, the intermediate transportation path 218 is provided with a junction point D at which the first junction path 246 and the second junction path 247 join each other and the intermediate transportation path 218 includes an outlet path 250 which is connected to the junction point D. That is, the downstream end of the first junction path 246, the downstream end of the second junction path 247, and the upstream end of the outlet path 250 are connected to the junction point D. The outlet path 250 extends downward in an area between the first inversion path 248 and the second inversion path 249 toward the post processing device 300, curves round the first inversion path 248, and extends upward. Note that, the outlet path 250 is constituted of a first outlet path 250*a* which is disposed on the upstream side and a second outlet path 250*b* which is disposed on the downstream side of the first outlet path 250*a*. In addition, the downstream end of the second outlet path 250*b* is connected to the downstream side transportation path 319 of the post processing device 300.

In addition, in the present embodiment, the inlet path 243, the first branch path 244, the second branch path 245 constitute a pre-inversion path 218*a* and the first junction path 246, the second junction path 247, and the outlet path 250 constitute a post-inversion path 218*b*. In addition, the pre-inversion path 218*a* is positioned on the upstream side of the first inverting unit 241 or the second inverting unit 242 in the transportation direction. Furthermore, the post-inversion path 218*b* is positioned on the downstream side of the first inverting unit 241 or the second inverting unit 242 in the transportation direction. That is, the intermediate transportation path 218 includes the pre-inversion path 218*a* which is positioned on the upstream side of the first inverting unit 241 and the second inverting unit 242 in the transportation direction and the post-inversion path 218*b* which is positioned on the downstream side of the first inverting unit 241 and the second inverting unit 242 in the transportation direction.

In addition, as illustrated in FIG. 3, the intermediate transportation device 200 includes the intermediate transportation unit 252 that can transport the paper sheet M along the intermediate transportation path 218. The first inverting unit 241 and the second inverting unit 242 in the intermediate transportation unit 252 are configured to be capable of inverting the transported paper sheet M.

A pair of first transportation rollers 254 which is driven by a first driving motor (not shown) is disposed on each of the inlet path 243, the first branch path 244, and the second branch path 245. In addition, a pair of second transportation rollers 256 which is driven by a second driving motor (not shown) is disposed on each of the first junction path 246, the second junction path 247, and the first outlet path 250*a*. In addition, pairs of third transportation rollers 257 which are driven by a third driving motor (not shown) are disposed on the second outlet path 250*b*. The number of the pairs of first transportation rollers 254, the pairs of second transportation rollers 256, and the pairs of third transportation rollers 257 can be arbitrarily set according to the shape or the like of each transportation path. In addition, one roller in each pair of rollers is driven in a state where both of the front and rear surfaces of the paper sheet M are supported while being interposed between each pair of rollers in the intermediate transportation unit 252 so that the paper sheet M is transported along the transportation path.

In addition, the inlet path 243 is provided with an introduction detecting unit 258 that detects the paper sheet M. The introduction detecting unit 258 is, for example, a photo interrupter and the specific configuration thereof is the same as that of the transportation detecting unit 199. In addition, the branch point A, which is on the downstream side of the introduction detecting unit 258 in the transportation direction, is provided with a guide flap 259. The guide flap 259 is driven by a solenoid or the like and switches a path to which the paper sheet M transported along the inlet path 243 is guided between the first branch path 244 and the second branch path 245.

Furthermore, a first restriction flap 261 that allows the paper sheet M to move from the first branch path 244 to the first inversion path 248 but restricts the paper sheet M from moving from the first inversion path 248 to the first branch path 244 is provided at the downstream end of the first branch path 244. Furthermore, a second restriction flap 262 that allows the paper sheet M to move from the second branch path 245 to the second inversion path 249 but restricts the paper sheet M from moving from the second inversion path 249 to the second branch path 245 is provided at the downstream end of the second branch path 245. The first restriction flap 261 and the second restriction flap 262 are urged so as to block the downstream end of the first branch path 244 or the second branch path 245 due to an urging force from an urging member (not shown).

In addition, on the first branch path 244, a first detecting unit 281 that detects the paper sheet M is disposed and on the second branch path 245, a second detecting unit 282 that detects the paper sheet M is disposed. In addition, on the first junction path 246, a third detecting unit 283 that detects the paper sheet M is disposed. Furthermore, on the first outlet path 250*a*, a fourth detecting unit 284 that detects the paper sheet M is disposed and on the second outlet path 250*b*, a fifth detecting unit 285 that detects the paper sheet M is disposed. Note that, the first to fifth detecting units 281, 282, 283, 284, and 285 are, for example, photo interrupters and the specific configuration thereof is the same as that of the transportation detecting unit 199. Note that, the number of each detecting unit in each transportation path can be arbitrarily set according to the shape or the like of each transportation path.

In the first inverting unit 241, a first inversion detecting unit 264 that detects the paper sheet M fed to the first inversion path 248 and pairs of first inverting rollers 265 (in the present embodiment, two pairs), which are provided on the first inversion path 248, are disposed. The pairs of first inverting rollers 265 are driven forwards or backwards by a first inversion motor (not shown) on the basis of a signal which the first inversion detecting unit 264 transmits when the first inversion detecting unit 264 detects the paper sheet M.

In addition, in the second inverting unit 242, a second inversion detecting unit 267 that detects the paper sheet M fed to the second inversion path 249 and pairs of second inverting rollers 268 (in the present embodiment, five pairs), which are provided on the second inversion path 249, are disposed. The pairs of second inverting rollers 268 are driven forwards or backwards by a second inversion motor (not shown) on the basis of a signal which the second inversion detecting unit 267 transmits when the second inversion detecting unit 267 detects the paper sheet M. Note that, the first and second inversion detecting units 264 and 267 are, for example, photo interrupters and the specific configuration thereof is the same as that of the transportation detecting unit 199.

Configuration of Post Processing Device

Next, a configuration of the post processing device 300 will be described. As illustrated in FIG. 1, the post processing device 300 includes an approximately box-shaped frame body 320. The frame body 320 includes a post processing paper feeding port 322 and a post processing paper discharging port 323. An opening is formed in each of the post processing paper feeding port 322 and the post processing paper discharging port 323 and the post processing paper feeding port 322 is disposed corresponding to the downstream end of the intermediate transportation path 218 of the intermediate transportation device 200 so that the intermediate transportation path 218 and the downstream side transportation path 319 are connected to each other. In addition, the downstream side transportation path 319 is disposed over an area from the post processing paper feeding port 322 to the post processing paper discharging port 323, the paper sheet M transported from the intermediate transportation device 200 is supplied via the post processing paper feeding port 322, and the paper sheet M is discharged via the post processing paper discharging port 323 after being subject to post processing or the like.

In the frame body 320, a mounting portion 328, a post processing unit 325, and the like are disposed. The paper sheet M is temporarily mounted on the mounting portion 328 and the mounting portion 328 includes a mounting surface 328*a* on which the paper sheet M can be mounted and which is a substantially flat surface, and a wall surface 328*b* which is formed to extend in a direction substantially perpendicular to an end of the mounting surface 328*a*.

Note that, on the mounting portion 328, a plurality of paper sheets M may be mounted being stacked and one paper sheet M may be mounted thereon.

The post processing unit 325 performs post processing such as a punching process of punching a punched hole through the paper sheet M, a stapling process of binding a predetermined number of paper sheets M, and a shifting process of shifting the position of the paper sheet M in the width direction thereof per one paper sheet M or per one bundle of paper sheets M for adjustment with respect to the paper sheet M mounted on the mounting portion 328 by using an appropriate mechanism. Note that, the post processing unit 325 may include a paper sheet folding unit that performs a folding process of the paper sheet M and a mechanism that is capable of performing a cutting process of cutting the paper sheet M, a quire making process of folding the paper sheet M, a bookbinding process of assembling a book from the paper sheet M, a gathering process and the like.

In addition, in the frame body 320, a downstream side transportation unit 335 is disposed along the downstream side transportation path 319. The downstream side transportation unit 335 includes a pair of transportation rollers 327 which is driven by a driving roller (not shown). In addition, a pair of discharging rollers 329 is disposed in the vicinity of the post processing paper discharging port 323 in the downstream side transportation path 319. The pair of transportation rollers 327 is disposed on the upstream side of the mounting portion 328 and the post processing unit 325 in the downstream side transportation path 319 and transports the paper sheet M, which is fed from the post processing paper feeding port 322, to the mounting portion 328. In addition, a transportation detecting unit 356 that detects the paper sheet M is disposed in the vicinity of the post processing paper feeding port 322 in the downstream side transportation path 319. The transportation detecting unit 356 is, for example, a photo interrupter and the specific configuration thereof is the same as that of the transportation detecting unit 199.

In addition, in the frame body 320, a guiding unit 330 that guides the paper sheet M transported along the downstream side transportation path 319 is provided. The guiding unit 330 has a projection-like shape. In addition, the guiding unit 330 includes a guiding surface 330*a* that is a substantially flat surface and the guiding surface 330*a* is disposed to face the downstream side transportation path 319 (mounting portion 328). The width dimension of the guiding surface 330*a* in the present embodiment in a direction approximately orthogonal to the transportation direction of the paper sheet M is substantially the same as the width dimension of the paper sheet M in a direction approximately orthogonal to the transportation direction. Accordingly, it is possible to transport the paper sheet M with ease. The guiding unit 330 is disposed on the downstream side of the pair of transportation rollers 327 in the downstream side transportation path 319 and is disposed on the upstream side of the pair of discharging rollers 329. Therefore, the paper sheet M transported from the pair of transportation rollers 327 is transported to the mounting portion 328 via the guiding unit 330.

The mounting portion 328 in the present embodiment is disposed on the downstream side of the pair of transportation rollers 327 in the downstream side transportation path 319 and the paper sheet M processed in the post processing unit 325 is temporarily mounted on the mounting portion 328. In addition, the mounting surface 328*a* of the mounting portion 328 is disposed in an oblique direction so that at least one end sides of the plurality of paper sheets M mounted on the mounting portion 328 are aligned. In the present embodiment, one end of the mounting portion 328 is disposed on the post processing paper discharging port 323 side and the other end (wall surface 328*b*) of the mounting portion 328 is disposed on the post processing unit 325 side. The post processing paper discharging port 323 is disposed above the post processing unit 325 and the mounting portion 328 is disposed obliquely so that the height thereof decreases toward the post processing unit 325. Therefore, one end sides of the paper sheets M mounted on the mounting portion 328 come into contact with the wall surface 328*b* of the mounting portion 328 and one end sides of the paper sheets M are aligned.

Figure 4:
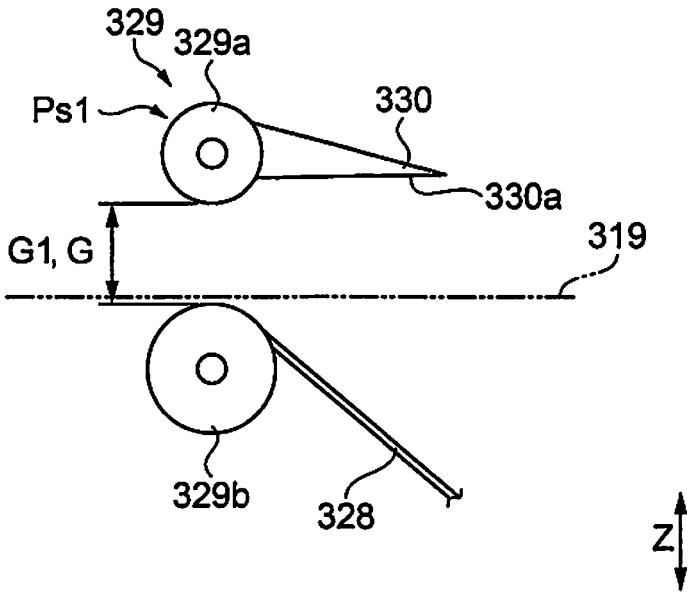
FIG. 4 is a schematic views illustrating the operation of a post processing device.
Figure 5:
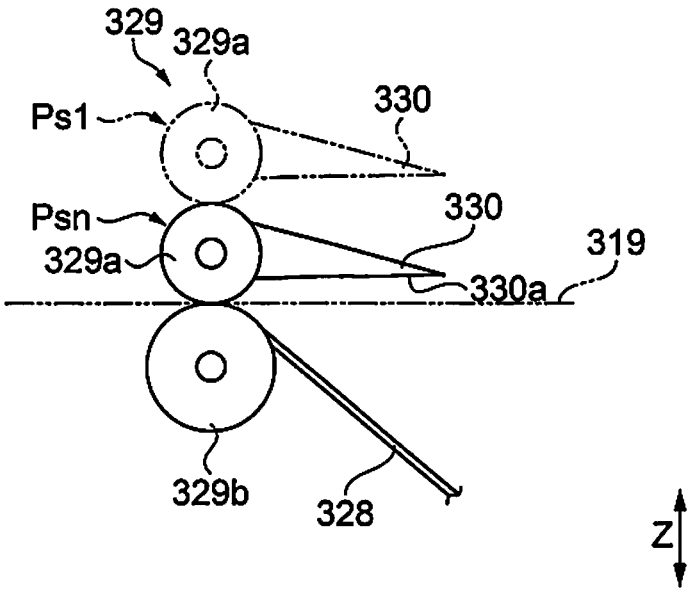
FIG. 5 is a schematic views illustrating the operation of the post processing device.

FIGS. 4 and 5 are schematic views illustrating the operation of the post processing device. Specifically, FIGS. 4 and 5 are schematic views illustrating the operation of the pair of discharging rollers 329. The pair of discharging rollers 329 is disposed close to one end of the mounting portion 328 and is configured to discharge the paper sheets M mounted on the mounting portion 328 in a one-by-one manner or to discharge bundles of paper sheets M in a one-by-one manner, each bundle including a predetermined number of paper sheets M. The pair of discharging rollers 329 includes a first discharging roller 329*a* and a second discharging roller 329*b*. The first discharging roller 329*a* and the second discharging roller 329*b* are arranged in the vertical direction Z and the first discharging roller 329*a* is disposed above the second discharging roller 329*b*. In addition, the first discharging roller 329*a* and the second discharging roller 329*b* can be separated from each other and can come into pressure contact with each other. In the present embodiment, the first discharging roller 329*a* can be moved relative to the second discharging roller 329*b* while being driven by a driving motor.

In addition, when the paper sheet M transported from the pair of transportation rollers 327 is mounted on the mounting portion 328, the first discharging roller 329*a* and the second discharging roller 329*b* of the pair of discharging rollers 329 are separated from each other as illustrated in FIG. 4. At this time, the first discharging roller 329*a* is disposed at a first position Ps1 at which a gap G between the first discharging roller 329*a* and the second discharging roller 329*b* becomes a first gap G1. The first position Ps1 is a defined home position and the first gap G1 is the maximum value of the gap G between the first discharging roller 329*a* and the second discharging roller 329*b*. Note that, the gap G is a gap in a direction in which the paper sheet M is interposed between the first discharging roller 329*a* and the second discharging roller 329*b* and is the shortest dimension between the outermost circumferential surface of the first discharging roller 329*a* and the outermost circumferential surface of the second discharging roller 329*b*. In addition, after a portion of the paper sheet M passes through an area between the first discharging roller 329*a* and the second discharging roller 329*b* in this state, as illustrated in FIG. 5, the first discharging roller 329*a* and the second discharging roller 329*b* come into pressure contact so that the paper sheet M is interposed (nipped) therebetween. Thereafter, the pair of discharging rollers 329 (329*a* and 329*b*) is rotated in such a direction that the paper sheet M returns to the mounting portion 328 side. Accordingly, the paper sheet M is mounted on the mounting portion 328. At this time, the first discharging roller 329*a* moves to a nip position Psn which is a position below the first position Ps1 and at which the first discharging roller 329*a* and the second discharging roller 329*b* nip the paper sheet M. The separation operation and the pressure contact operation of the first discharging roller 329*a* and the second discharging roller 329*b* are repeated until a predetermined number of paper sheets M are mounted on the mounting portion 328.

In addition, in a case where the paper sheet M subject to the post processing in the post processing unit 325 is discharged to the discharging tray 331 side, a predetermined number of paper sheets M are nipped and the pair of discharging rollers 329 (first discharging roller 329*a* and second discharging roller 329*b*) is rotated in such a direction that the predetermined number of paper sheets M are transported to a side opposite to the mounting portion 328 side. Accordingly, it is possible to discharge the paper sheet M to the discharging tray 331 side. At this time, the first discharging roller 329*a* is disposed at the nip position Psn at which the first discharging roller 329*a* and the second discharging roller 329*b* nip the paper sheet M mounted on the mounting portion 328 (refer to FIG. 5).

The discharging tray 331 is provided on the outside of the frame body 320 and the paper sheet M discharged through the post processing paper discharging port 323 is mounted thereon. The discharging tray 331 includes a mounting surface 331*a* on which the paper sheets M is loaded (mounted) and the discharging tray 331 is provided to protrude outwards from the frame body 320.

Basic Operating Method of Printing System

Next, a basic operating method of the printing system 1 will be described. FIGS. 6 to 9 are schematic views illustrating an operating method of the printing system. Hereinafter, transportation of the paper sheet M, which is transported from the printing device 100 to the post processing device 300 through the intermediate transportation device 200, will be described. Note that, in the following description, the first to third paper sheets M of the paper sheets M which are supplied to the recording head 111 of the printing device 100 and are transported are called a first paper sheet Ma, a second paper sheet Mb, and a third paper sheet Mc, respectively, and the fourth paper sheet M is called a fourth paper sheet Md.

First, when a printing process (image forming process) is executed, the controller 10 drives each of the driving motors and the like. As a result, the pickup roller 142*a*, the pair of transportation rollers 131, the driving roller 133, the pair of first transportation rollers 254, the pair of second transportation rollers 256, the third pair of transportation rollers 257, the pair of first inverting rollers 265, the pair of second inverting rollers 268, the pair of transportation rollers 327, and the like, which are connected to each driving roller, are driven.

Then, the recording unit 110 forms (prints) an image by ejecting ink from the recording head 111 to the paper sheet M. In this case, the printing process may be any of simplex printing and duplex printing.

Figure 6:
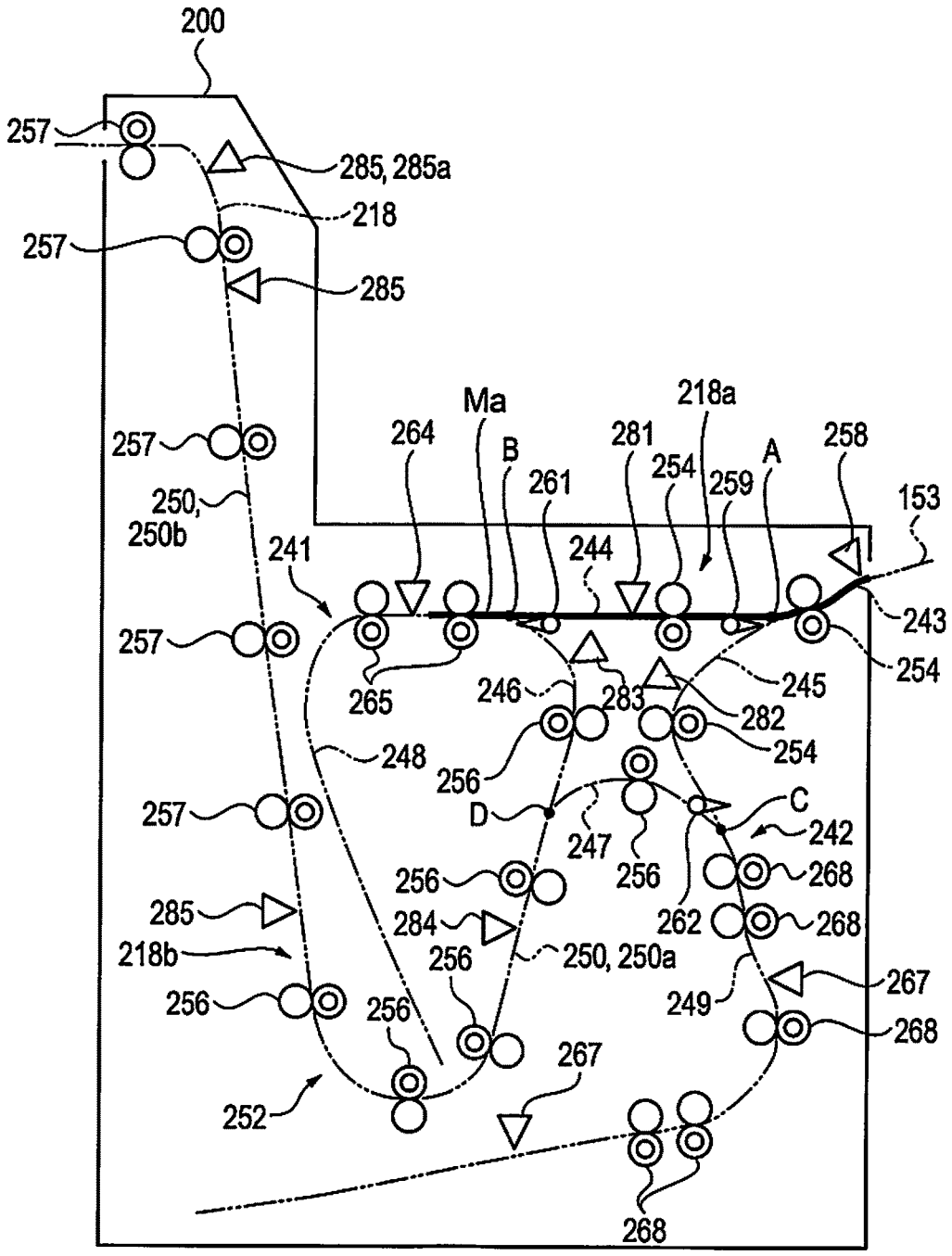
FIG. 6 is a schematic view illustrating an operating method of the printing system.

Then, as illustrated in FIG. 6, the first paper sheet Ma which is transported along the third discharging path 153 at a pre-inversion speed is handed over to the inlet path 243 at the approximately same speed. When the introduction detecting unit 258 detects the leading end of the first paper sheet Ma, the controller 10 drives a solenoid such that the guide flap 259 is positioned at a first position P1. That is, the guide flap 259 guides the first paper sheet Ma toward the first branch path 244. Then, the leading end of the first paper sheet Ma which has been transported to the first connection point B comes into contact with the first restriction flap 261 so as to move the first restriction flap 261 against an urging force of an urging member. That is, the first restriction flap 261 is moved such that the downstream end of the first branch path 244 opens. Therefore, the first paper sheet Ma is fed into the first inversion path 248 at the pre-inversion speed by the pairs of first inverting rollers 265 being driven forwards. In addition, when the first paper sheet Ma passes through the first restriction flap 261, the first restriction flap 261 moves to a position at which the first restriction flap 261 closes the downstream end of the first branch path 244 from a position at which the first restriction flap 261 opens the downstream end of the first branch path 244.

Figure 7:
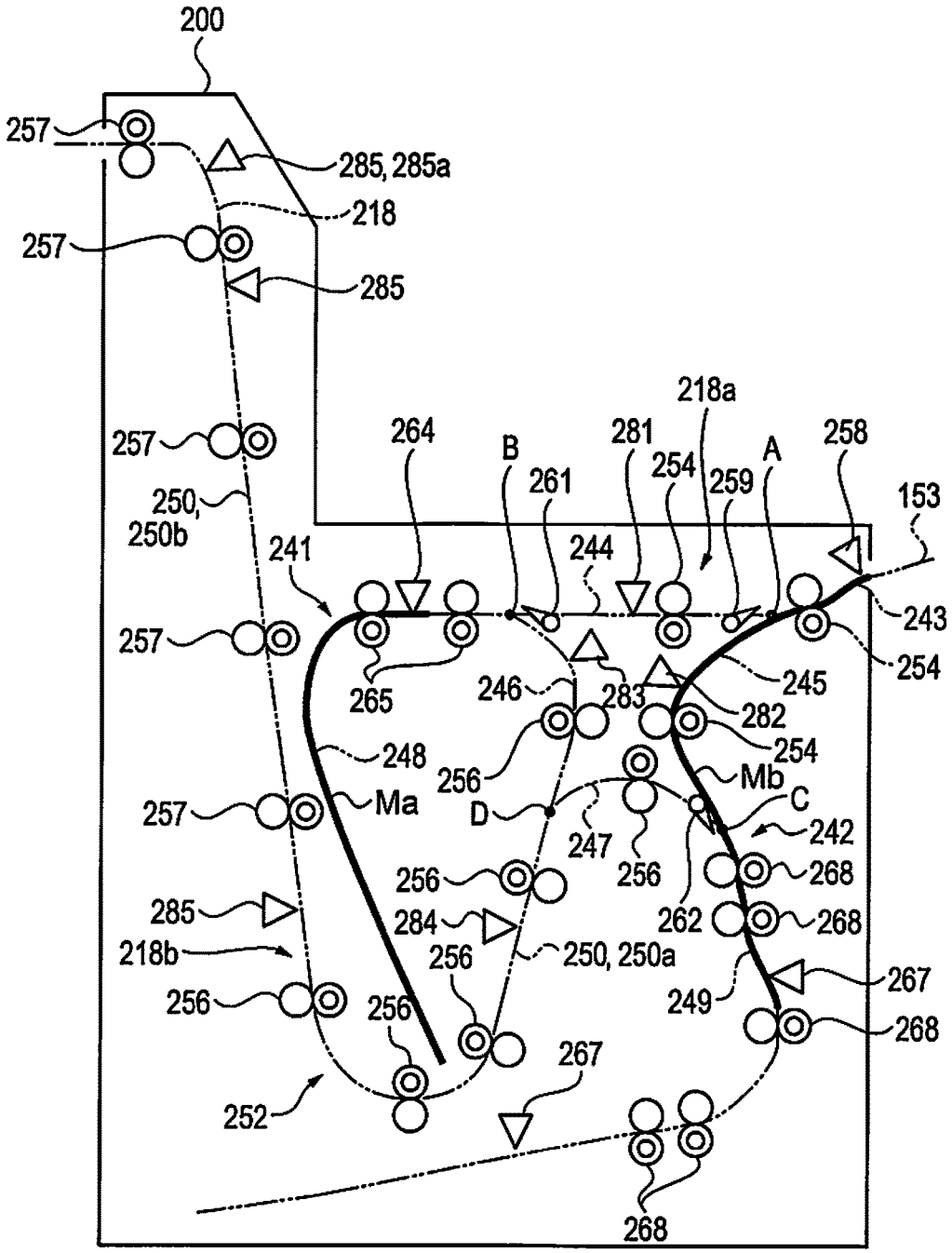
FIG. 7 is a schematic view illustrating the operating method of the printing system.

As illustrated in FIG. 7, when the first inversion detecting unit 264 detects the trailing end of the first paper sheet Ma, the controller 10 switches a driving mode of the pair of first inverting rollers 265 from a forward driving-mode to a backward-driving mode. Then, the first inverting unit 241 feeds the first paper sheet Ma to the first connection point B side from the first inversion path 248 at a post-inversion speed. In addition, at this time, the first restriction flap 261 guides the first paper sheet Ma to the first junction path 246. That is, in the first inverting unit 241, the first paper sheet Ma which is fed from the first branch path 244 is fed to the first junction path 246 so that the orientation of the first paper sheet Ma is inverted (switch-back).

In addition, when the introduction detecting unit 258 detects the leading end of the second paper sheet Mb, the controller 10 drives the solenoid such that the position of the guide flap 259 is changed. That is, the controller 10 causes the guide flap 259 positioned at the first position P1 to move to a second position P2. Then, the guide flap 259 guides the second paper sheet Mb to the second branch path 245.

Figure 8:
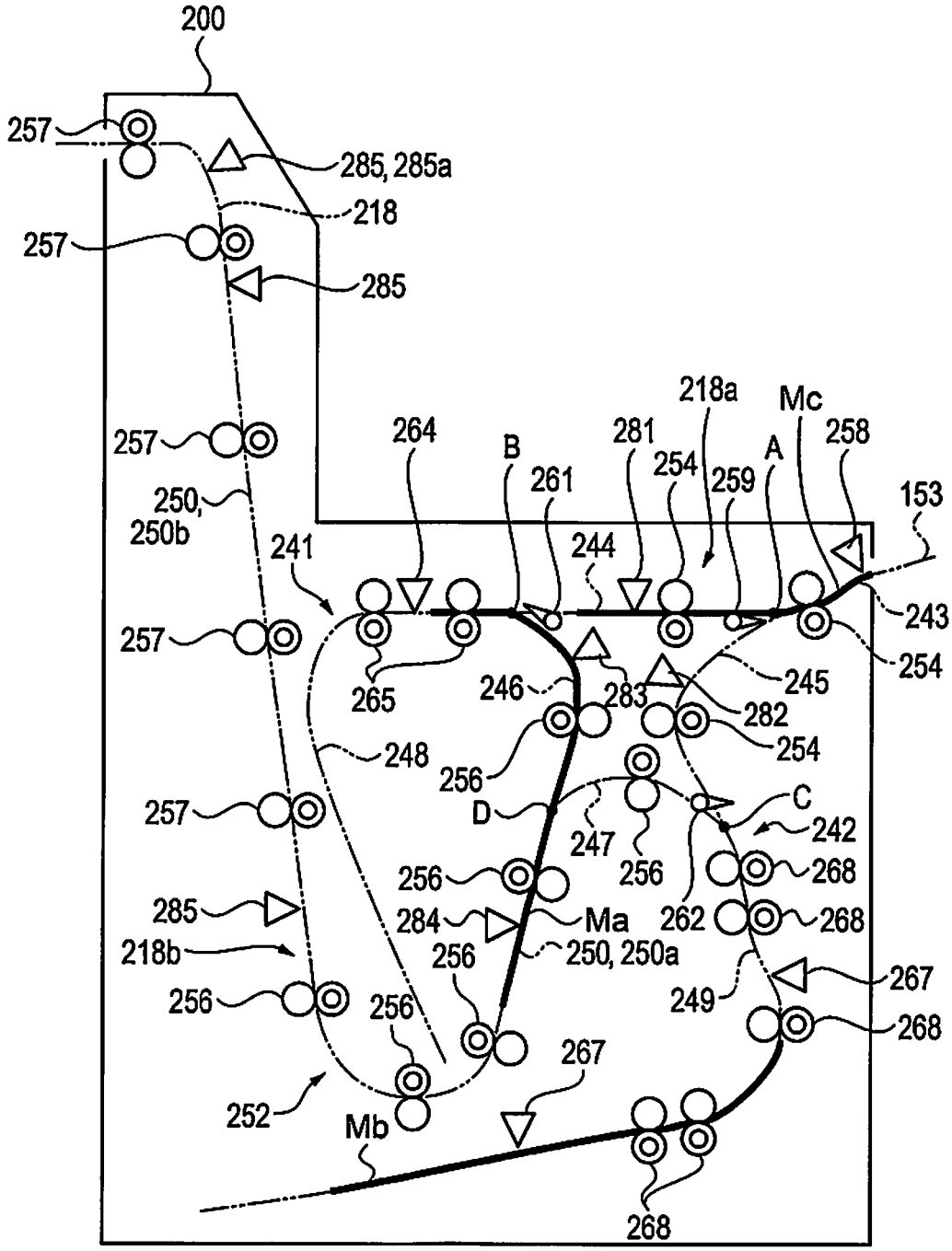
FIG. 8 is a schematic view illustrating the operating method of the printing system.

As illustrated in FIG. 8, the first paper sheet Ma which has been inverted by the first inverting unit 241 is transported along the post-inversion path 218*b* at the post-inversion speed. When the first paper sheet Ma passes through the first connection point B, the controller 10 causes the pairs of first inverting rollers 265 to rotate forwards. In addition, when the second inversion detecting unit 267 detects the trailing end of the second paper sheet Mb, the controller 10 causes the pair of second inverting rollers 268 to rotate backwards. That is, in the second inverting unit 242, the second paper sheet Mb is inverted as in the first inverting unit 241 and is fed to the second junction path 247.

Furthermore, when the introduction detecting unit 258 detects the leading end of the third paper sheet Mc, the controller 10 drives the solenoid so that the position of the guide flap 259 is changed. Specifically, the controller 10 causes the guide flap 259 positioned at the second position P2 to move to the first position P1. That is, the guide flap 259 guides the transported paper sheet M to the first branch path 244 and the second branch path 245 alternately.

Figure 9:
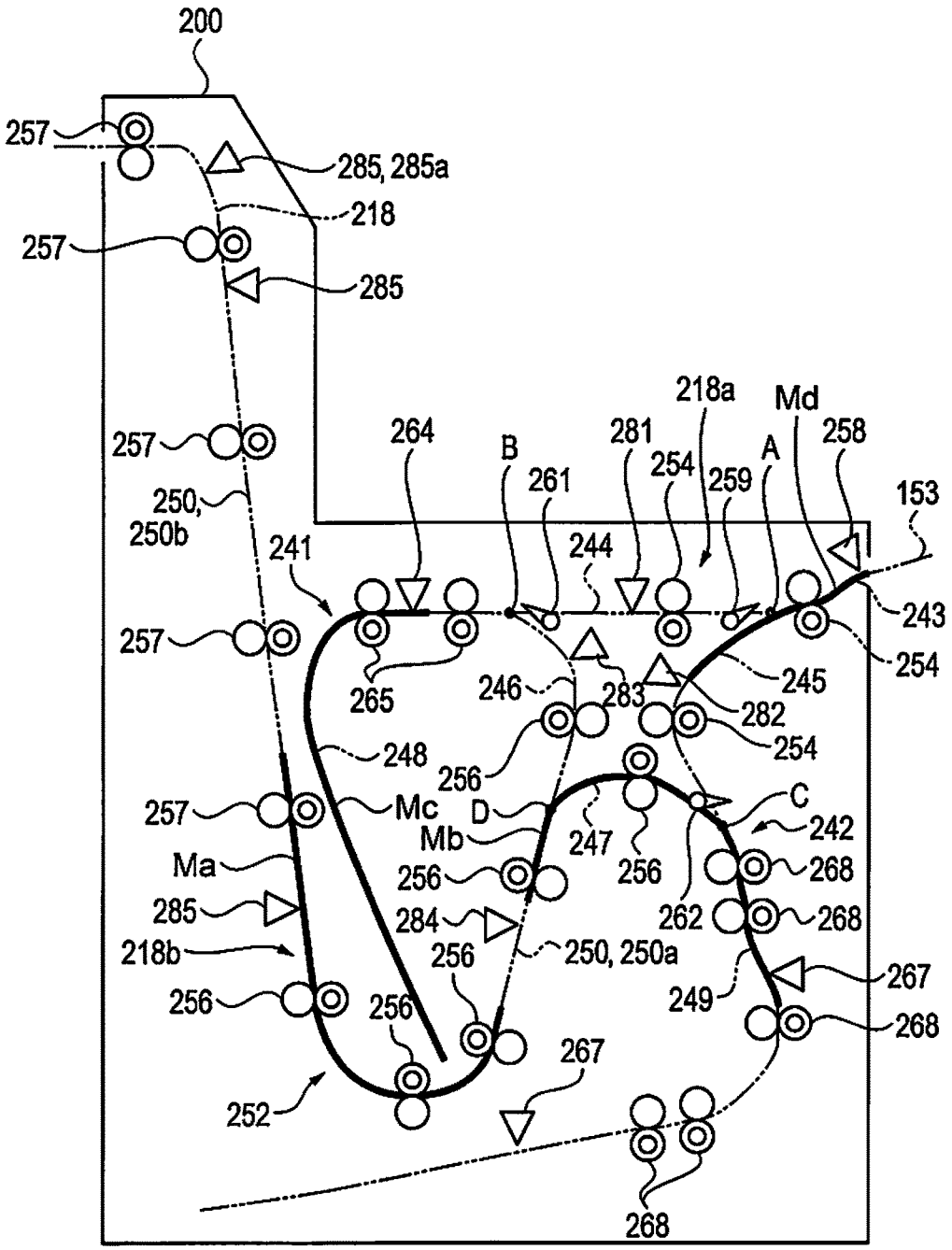
FIG. 9 is a schematic view illustrating the operating method of the printing system.

As illustrated in FIG. 9, the second paper sheet Mb which is inverted in the second inverting unit 242 and is fed to the second junction path 247 is transported along the outlet path 250 while bypassing the junction point D. Note that, at this time, the intermediate transportation unit 252 transports the first paper sheet Ma and the second paper sheet Mb at the post-inversion speed which is lower than the pre-inversion speed. Therefore, a gap between the first paper sheet Ma and the second paper sheet Mb in the transportation direction becomes smaller than that in a case where the first paper sheet Ma and the second paper sheet Mb are transported along the pre-inversion path 218*a* at the pre-inversion speed.

In addition, when the first inversion detecting unit 264 detects the trailing end of the third paper sheet Mc, the controller 10 causes the pair of first inverting rollers 265 to rotate backwards so that the third paper sheet Mc is fed to the first junction path 246.

In addition, when the introduction detecting unit 258 detects the leading end of the fourth paper sheet Md, the controller 10 drives the solenoid so that the position of the guide flap 259 is changed to the second position P2.

Then, the intermediate transportation device 200 feeds the paper sheets M to the post processing device 300 in such an order that the first paper sheet Ma, which enters the intermediate transportation device 200 first, is fed to the post processing device 300 first. That is, the paper sheets M are fed to the post processing device 300 after the paper sheets M are inverted in the intermediate transportation device 200. In addition, since the downstream side transportation unit 335 transports the paper sheet M at a processing speed which is higher than the post-inversion speed, a gap between the paper sheets M is expanded. The paper sheets M are sequentially transported to the mounting portion 328 and when a predetermined number of paper sheets M are mounted on the mounting portion 328, the post processing unit 325 performs processing such as stapling and the paper sheets M are discharged to a discharging tray 331 with the pair of discharging rollers 329 being driven.

Next, an object to be achieved by using the post processing device 300 according to the present embodiment will be described. As described above, in a case where the printing device 100 is an ink jet printer that includes the recording head 111 ejecting ink in the form of liquid droplets, the paper sheet M on which an image has been formed in the printing device 100 may curl (paper sheet may curve or paper sheet may be rolled up) due to absorption of ink (moisture), the drying of ink, and the like. Therefore, in a case where the paper sheets M on each of which an image has been formed in the printing device 100 (ink jet printer) are sequentially mounted on the mounting portion 328, if the paper sheet M, which is mounted on the mounting portion 328 earlier, curls greatly, there is a possibility of transportation failure resulting from contact between a curled portion of the paper sheet M which is mounted earlier and the paper sheet M which is transported later.

Furthermore, the mechanism of occurrence of the curling of the paper sheet M will be described in detail. The paper sheet M in the present embodiment contains cellulose as a main component and is formed through hydrogen bonding between cellulose. Therefore, if ink is applied to one surface of the paper sheet M by the printing device 100, a hydrogen bond between cellulose is divided due to absorption of ink. As a result, a gap between cellulose is expanded and the one surface of the paper sheet M to which ink is applied becomes more likely to expand than the other surface which is opposite to the one surface of the paper sheet M. Therefore, in a case where the paper sheet M is mounted with the one surface facing a gravity direction (downward), the paper sheet M curls (first curling effect) to have a convex shape in the gravity direction.

In addition, if ink absorbed by the paper sheet M starts to be dried after the first curling effect, cellulose is freely bonded through hydrogen bonding and the gap between cellulose becomes short. As a result, the one surface of the paper sheet M to which ink is applied shrinks more than the other surface. Therefore, in a case where the paper sheet M is mounted with the one surface facing the gravity direction, the paper sheet M curls (second curling effect) to have a concave shape in the gravity direction, contrary to the case of the first curling effect (convex shape in direction opposite to gravity direction).

Here, in the post processing device 300 according to the present embodiment, the curling of the paper sheet M (particularly, second curling effect) causes a problem. Specifically, the paper sheet M on which an image has been formed in the printing device 100 is transported to the post processing device 300 via the intermediate transportation device 200. In this process, since the second curling effect becomes great as ink applied to the paper sheet M dries with time, for example, in a case where transportation failure (jam) of the paper sheet M occurs in the third discharging path 153, the intermediate transportation path 218, the downstream side transportation path 319, and the like and thus the transportation of the paper sheet M is stopped, the paper sheet M already mounted on the mounting portion 328 curls greatly (second curling effect becomes great) as time elapses. In addition, in a case where a jam is fixed, the transportation of the paper sheet M is restarted, and the paper sheet M transported after the jam is fixed is transported to the mounting portion 328, the paper sheet M transported later is caught on a curled portion of the paper sheet M already mounted on the mounting portion 328, which results in transportation failure. Particularly, in a case where the curling of the paper sheet M already transported to the mounting portion 328 (second curling effect in which the paper sheet M is deformed to be concave with respect to the mounting surface 328*a*) occurs such that the paper sheet M is deformed with end portions thereof rise higher than the central portion with respect to the mounting surface 328*a*, the paper sheet M transported later is more likely to be caught on the curled portion and the transportation failure is more likely to occur. In a case where the curling of the paper sheet M (second curling effect in which the paper sheet M is deformed to be convex with respect to the mounting surface 328*a*) occurs such that the paper sheet M is deformed with the central portion rises higher than the end portions with respect to the mounting surface 328*a*, a deformation amount of paper sheet M is small due to the own weight of the paper sheet M and this is also regarded as a transportation problem related to deformation (curling) of the paper sheet M although the transportation failure is less likely to occur in comparison with the above-described second curling effect in which the paper sheet M is deformed to be concave.

In addition, the paper sheet M curls not only in simplex printing but also in duplex printing. That is, the paper sheet M may curl in a case where the printing duty of the one surface of the paper sheet M and the printing duty of the other surface are different from each other. Particularly, the curling of the paper sheet M occurs frequently in a case where a difference between the printing duty of the one surface of the paper sheet M and the printing duty of the other surface is equal to or greater than a predetermined value (for example, approximately 30% or more). Note that, "duty" is a value calculated from duty (%)=number of actually recorded dots/(vertical resolution×horizontal resolution)×100 (where "number of actually recorded dots" is the number of actually recorded dots per unit area and each of "vertical resolution" and "horizontal resolution" is a resolution per unit area).

Therefore, the post processing device 300 is provided with a suppressing unit 450 which suppresses deformation (curling) of the paper sheet M mounted on the mounting portion 328. With the suppressing unit 450, it is possible to suppress transportation failure of the paper sheet M which is caused by the curling of the paper sheet M mounted on the mounting portion 328 (particularly, second curling effect).

Figure 10:
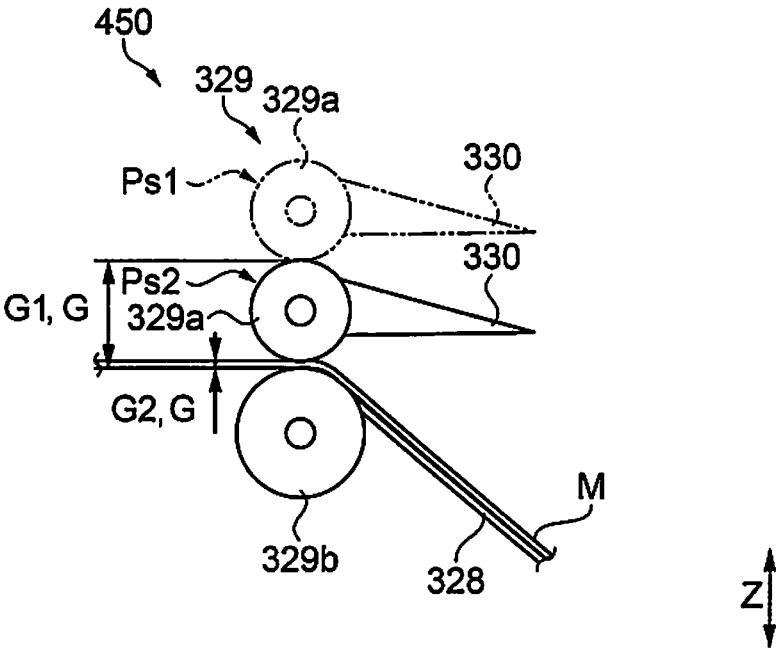
FIG. 10 is a schematic view illustrating a configuration of a suppressing unit.
Figure 11:
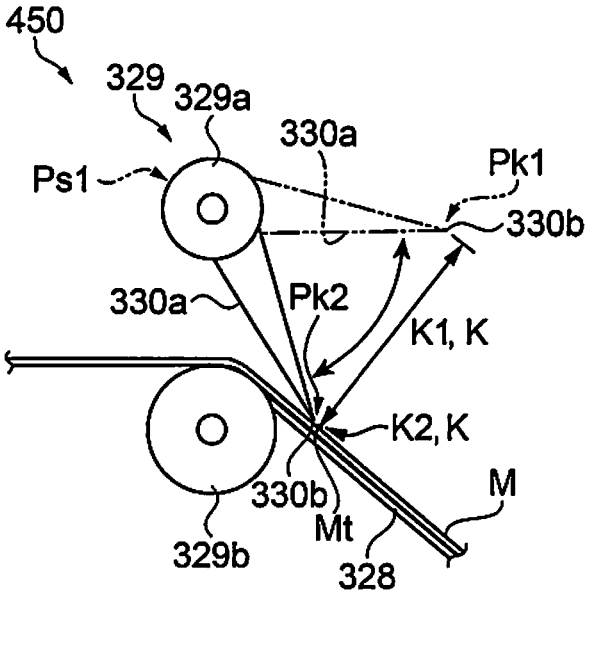
FIG. 11 is a schematic view illustrating a configuration of the suppressing unit.
Figure 12:
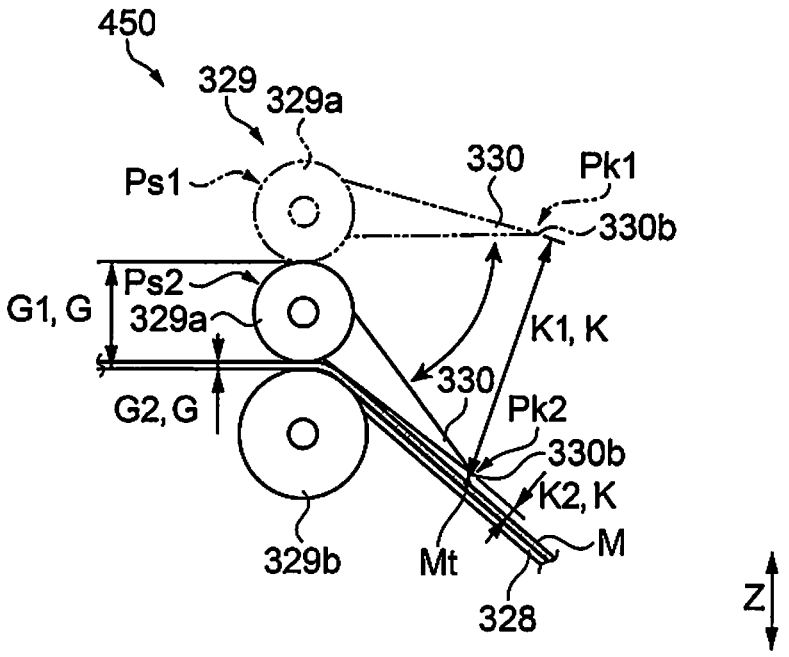
FIG. 12 is a schematic view illustrating a configuration of the suppressing unit.

Next, a configuration of the suppressing unit will be described. FIGS. 10, 11, and 12 are schematic views illustrating a configuration of each suppressing unit. In an example of FIG. 10, the pair of discharging rollers 329 has a function as the suppressing unit 450. The pair of discharging rollers 329 as the suppressing unit 450 suppresses the deformation (curling) of the paper sheet M between the mounting portion 328 and the discharging tray 331. That is, the pair of discharging rollers 329 suppresses the curling of the paper sheet M with the mounting portion 328 not being involved with the suppression. Specifically, the pair of discharging rollers 329 as the suppressing unit 450 includes the first discharging roller 329*a* as a first roller and the second discharging roller 329*b* as a second roller.

In addition, as illustrated in FIG. 10, the gap G between the first discharging roller 329*a* and the second discharging roller 329*b* can be changed to the first gap G1 and a second gap G2 which is a gap G smaller than the first gap G1. Note that, in the present embodiment, in a case where the first discharging roller 329*a* is positioned at the first position Ps1, the first gap G1 is set (refer to FIG. 4). In addition, the first discharging roller 329*a* can arbitrarily move between the first position Ps1 and the nip position Psn (refer to FIG. 5). In addition, the second gap G2 which is a gap G smaller than the first gap G1 can be set by moving the first discharging roller 329*a* from the first position Ps1 to the second discharging roller 329*b* side. Accordingly, the nip position Psn can also function as a second position Ps2.

In addition, in a case where the deformation of the paper sheet M mounted on the mounting portion 328 is suppressed, the gap G between the first discharging roller 329*a* and the second discharging roller 329*b* is set to the second gap G2, which is a gap G smaller than the first gap G1, with the paper sheet M, which is mounted on the mounting portion 328, being interposed between the first discharging roller 329*a* and the second discharging roller 329*b*. That is, the first discharging roller 329*a* is moved from the first position Ps1 to the second position Ps2. Accordingly, the gap G between the first discharging roller 329*a* and the second discharging roller 329*b* becomes smaller than the first gap G1 and thus the deformation (curling) of the paper sheet M is restricted.

In addition, in a case where the deformation of the paper sheet M mounted on the mounting portion 328 is suppressed, it is preferable that the second position Ps2 of the first discharging roller 329*a* be set as the nip position Psn at which the paper sheet M is nipped. That is, when the first discharging roller 329*a* is disposed at the first position Ps1 at which the gap G becomes the first gap G1, the first discharging roller 329*a* does not come into contact with the paper sheet M although the second discharging roller 329*b* comes into contact with the paper sheet M. On the other hand, when the first discharging roller 329*a* is disposed at the nip position Psn (second position Ps2) at which the gap G becomes the second gap G2, the first discharging roller 329*a* and the second discharging roller 329*b* come into contact with the paper sheet M. In this case, since the paper sheet M is pressed by the first discharging roller 329*a* and the second discharging roller 329*b* and a flat shape of a portion of the paper sheet M is maintained, the curling of the paper sheet M is suppressed. In addition, since the paper sheet M is pressed, the front surface of the paper sheet M is not likely to be exposed to the outside air. Therefore, the drying of ink applied to the paper sheet M is suppressed and thus it is possible to suppress the curling of the paper sheet M. Note that, a nipping force pertaining to a case where the second position Ps2 is set as the nip position Psn is smaller than a nipping force pertaining to a case where the paper sheet M is transported in a usual manner and may be set to such a pressure that the paper sheet M can be drawn with fingers. It is possible to reduce the load applied to the pair of discharging rollers 329.

Furthermore, in an example of FIG. 11, the guiding unit 330 can function as the suppressing unit 450 separately from the pair of discharging rollers 329. The guiding unit 330 as the suppressing unit 450 suppresses the deformation (curling) of the paper sheet M on the mounting portion 328. That is, the guiding unit 330 suppresses the curling of the paper sheet M with a portion of the mounting portion 328 (mounting surface 328*a* on which paper sheet M is mounted or like) being involved with the suppression. Specifically, the guiding unit 330 as the suppressing unit 450 includes the guiding surface 330*a* as a portion of a contact portion which can come into contact with a surface of the paper sheet M. In addition, a gap K between the paper sheet M mounted on the mounting portion 328 and the guiding surface 330*a* can be changed to a first gap K1 and a second gap K2 which is a gap K smaller than the first gap K1. The guiding unit 330 in the present embodiment is connected to a driving motor and is configured to be capable of rotating around the axis of the first discharging roller 329*a*.

In the present embodiment, the guiding unit 330 can move between a first position Pk1 (home position), at which the guiding unit 330 is disposed when the paper sheet M is transported, and a second position Pk2, at which the guiding surface 330*a* is brought close to the paper sheet M side in order to suppress the deformation of the paper sheet M. Accordingly, the gap K between the paper sheet M mounted on the mounting portion 328 and the guiding surface 330*a* can be changed. Therefore, the gap K between the paper sheet M mounted on the mounting portion 328 and the guiding surface 330*a* can be changed to the first gap K1 and the second gap K2 which is a gap K smaller than the first gap K1. Note that, in the present embodiment, the gap K can be set to a dimension between a tip end portion 330*b* (which is end portion of guiding unit 330 opposite to first discharging roller 329*a* and portion of contact portion) of the guiding unit 330 and a definition point (fixed point) Mt set on the paper sheet M. Therefore, it is possible to define the gap K between the paper sheet M and the guiding surface 330*a*.

In a case where the deformation of the paper sheet M mounted on the mounting portion 328 is suppressed, the guiding unit 330 is moved from the first position Pk1 to the second position Pk2 so that the gap K between the paper sheet M and the guiding surface 330*a* is changed to the second gap K2 which is smaller than the first gap K1. As a result, the gap K between the paper sheet M and the guiding surface 330*a* becomes small and the deformation (curling) of the paper sheet M is restricted. Note that, in a case where the deformation of the paper sheet M mounted on the mounting portion 328 suppressed, it is preferable that the guiding unit 330 be moved while using a position at which the tip end portion 330*b* of the guiding unit 330 can press the paper sheet M mounted on the mounting portion 328 as the second position Pk2. That is, when the guiding unit 330 is disposed at the first position Pk1 at which the gap K becomes the first gap K1, the guiding surface 330*a* and the tip end portion 330*b* of the guiding unit 330 do not come into contact with the paper sheet M. On the other hand, when the guiding unit 330 is disposed at the second position Pk2 at which the gap K become the second gap K2, the tip end portion 330*b* of the guiding unit 330 comes into contact with the paper sheet M. In this case, since the paper sheet M is pressed by the guiding unit 330 and a substantially flat shape of a portion of the paper sheet M is maintained, it is possible to efficiently suppress the curling of the paper sheet M.

Note that, in the present embodiment, the pair of discharging rollers 329 and the guiding unit 330 are configured as the suppressing unit 450, as illustrated in FIG. 12. Specifically, in a case where the deformation of the paper sheet M mounted on the mounting portion 328 is suppressed, the gap G between the first discharging roller 329*a* and the second discharging roller 329*b* is set to the second gap G2 with the paper sheet M, which is mounted on the mounting portion 328, being interposed between the first discharging roller 329*a* and the second discharging roller 329*b*. That is, the first discharging roller 329*a* is moved from the first position Ps1 to the second position Ps2. Furthermore, the gap K between the paper sheet M mounted on the mounting portion 328 and the guiding surface 330*a* is set to the second gap K2. That is, the guiding unit 330 is moved from the first position Pk1 to the second position Pk2. Accordingly, the deformation (curling) of the paper sheet M mounted on the mounting portion 328 is restricted by the pair of discharging rollers 329 and the guiding unit 330 and thus it is possible to further suppress the deformation (curling) of the paper sheet M.

Figure 13:
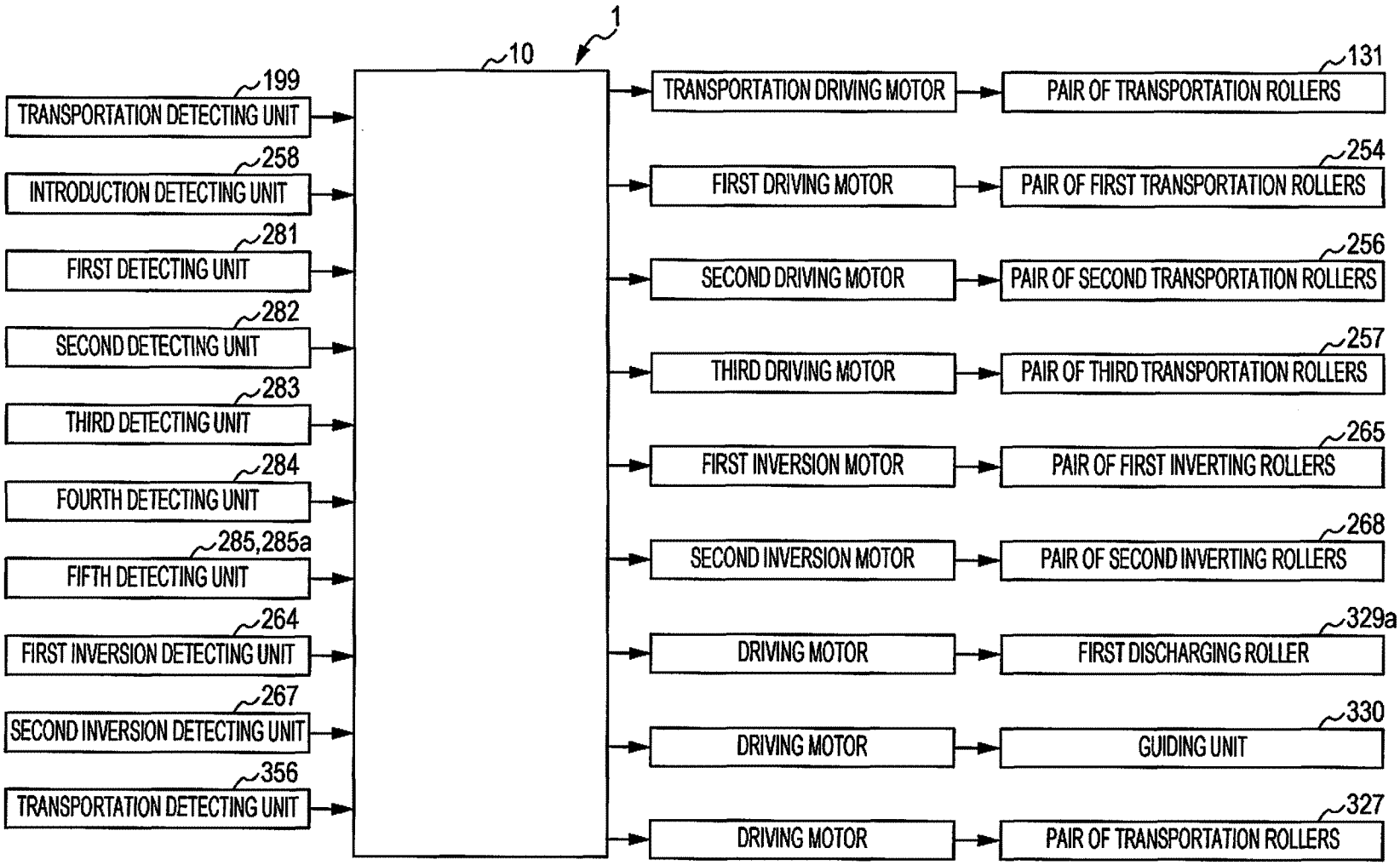
FIG. 13 is a block diagram partially illustrating a configuration of a controller in the printing system.

Next, a configuration of the controller in the printing system will be described. FIG. 13 is a block diagram partially illustrating a configuration of the controller in the printing system. Note that, FIG. 13 mainly illustrates a configuration related to control of the suppressing unit 450.

As illustrated in FIG. 13, the printing system 1 includes the controller 10. The controller 10 includes a CPU, a ROM and a RAM as storage units, and an input-output interface. The CPU processes various signals input via the input-output interface on the basis of data in the ROM and the RAM and outputs a control signal to each driving unit via the input-output interface. The CPU performs various control operations on the basis of, for example, a control program stored in the ROM.

The controller 10 is connected to the detecting units (transportation detecting unit 199, introduction detecting unit 258, first to fifth detecting units 281, 282, 283, 284, and 285, first and second inversion detecting units 264 and 267, and transportation detecting unit 356) and detection data is transmitted from the each detecting unit to the controller 10. In addition, the controller 10 is connected to the driving motors (transportation driving motor, first to third driving motors, first and second inversion motors, and each driving motor) and a driving control signal generated on the basis of the detection data is transmitted from the controller 10 to each driving motor so that each driving motor is controlled. In addition, when each driving motor is driven, members which are connected to the driving motors such as the pairs of rollers (pair of transportation rollers 131, pair of first transportation rollers 254, pair of second transportation rollers 256, pair of third transportation rollers 257, pair of first inverting rollers 265, pair of second inverting rollers 268, first discharging roller 329*a*, guiding unit 330, and pair of transportation rollers 327) are driven.

Figure 14:
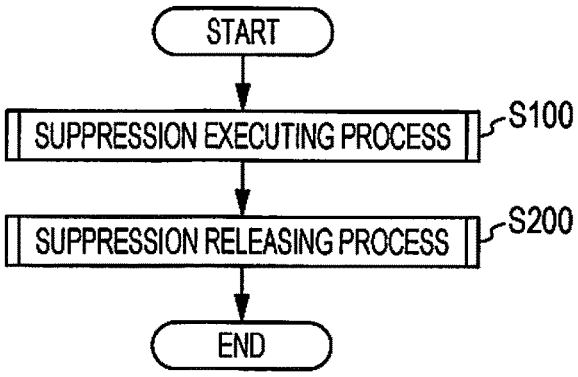
FIG. 14 is a flowchart illustrating a control method of the printing system.

Next, a control method of the printing system will be described. Specifically, a control method of the suppressing unit will be described. FIG. 14 is a flowchart illustrating the control method of the printing system. As illustrated in FIG. 14, the control method of the printing system is executed through a suppression executing process in Step S100 and a suppression releasing process in Step S200. In the suppression executing process in Step S100, the deformation (curling) of the paper sheet M is suppressed by the suppressing unit 450 in a case where a jam occurs on the upstream side of the mounting portion 328 in the transportation path (third discharging path 153, intermediate transportation path 218, and downstream side transportation path 319) of the paper sheet M. Specifically, in a case where a jam occurs, the suppressing unit 450 is driven (started) after the paper sheet M on the downstream side of a position, at which the jam occurs, in the transportation path is transported to the mounting portion 328. In addition, in the suppression releasing process in Step S200, in a case where a jam is fixed, the paper sheet M which is transported to the mounting portion 328 first can be mounted on the mounting portion 328 after the jam is fixed and the suppressing unit 450 is deactivated on the basis of the result of detection performed by a detecting unit which is disposed on the upstream side of the suppressing unit 450 in the transportation path and is closest to the suppressing unit 450.

In other words, in the suppression releasing process in Step S200, in a case where a jam is fixed, the suppressing unit 450 is deactivated on the basis of the result of detection performed by the detecting unit which is disposed in a transportation path on the upstream side of the suppressing unit 450 and is closest to the suppressing unit 450. Hereinafter, specific description will be made.

Figure 15:
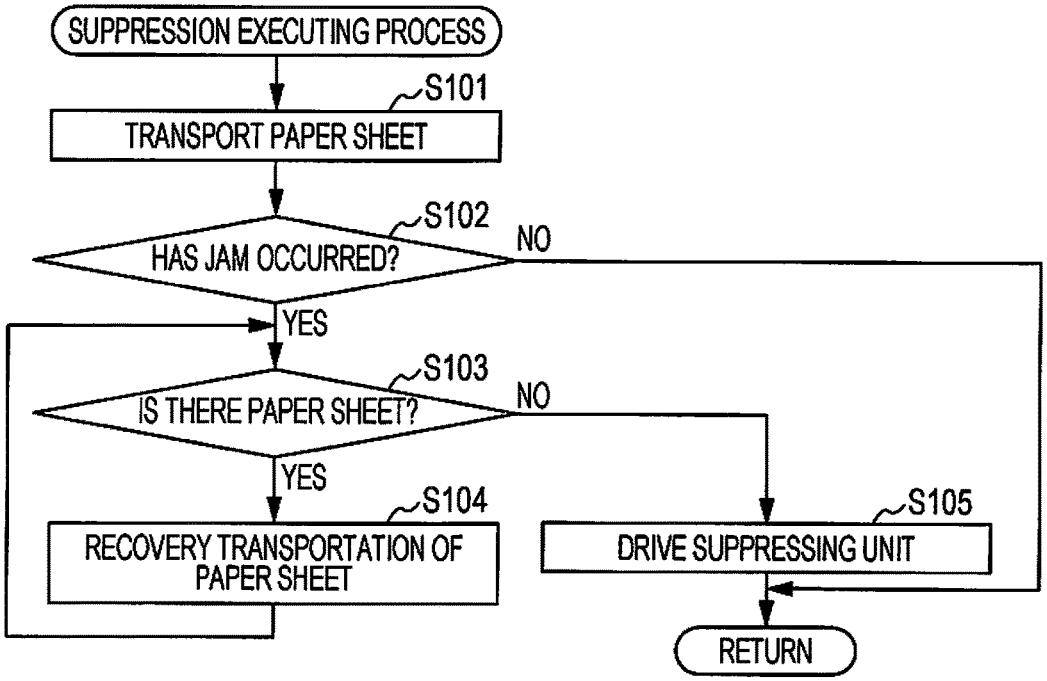
FIG. 15 is a flowchart illustrating a suppression executing process.

First, the suppression executing process will be described. FIG. 15 is a flowchart illustrating the suppression executing process. As illustrated in FIG. 15, in Step S101, the paper sheet M is transported. Specifically, the pairs of transportation rollers (pair of transportation rollers 131, pair of first transportation rollers 254, pair of second transportation rollers 256, pair of third transportation rollers 257, pair of first inverting rollers 265, pair of second inverting rollers 268, pair of discharging rollers 329, and pair of transportation rollers 327) in the printing device 100, the intermediate transportation device 200, and the post processing device 300 are driven. In addition, the recording unit 110 in the printing device 100 is driven so that an image is formed on the transported paper sheet M. As a result, the paper sheet M with an image formed thereon is transported to the third discharging path 153, the intermediate transportation path 218, and the downstream side transportation path 319.

Next, in Step S102, it is determined whether a jam has occurred or not. Specifically, the controller 10 determines whether a jam has occurred or not in the third discharging path 153, the intermediate transportation path 218, and the downstream side transportation path 319 which are transportation paths on the upstream side of the mounting portion 328. It is determined whether a jam has occurred or not on the basis of the detection data transmitted from the detecting units (transportation detecting unit 199, introduction detecting unit 258, first to fifth detecting units 281, 282, 283, 284, and 285, first and second inversion detecting units 264 and 267, and transportation detecting unit 356) which are disposed in the transportation path. In a case where it is determined that a jam has occurred (YES), the process transitions to Step S103 and in a case where it is determined that a jam has not occurred (NO), the process is terminated (return).

Next, in a case where the process transitions to Step S103, it is determined whether the paper sheet M is present between a position at which the jam occurs and the mounting portion 328. Specifically, it is determined whether the paper sheet M is present between a position at which the jam occurs and the mounting portion 328 on the basis of the detection data transmitted from the detecting units (transportation detecting unit 199, introduction detecting unit 258, first to fifth detecting units 281, 282, 283, 284, and 285, first and second inversion detecting units 264 and 267, and transportation detecting unit 356) which are disposed between the position at which the jam occurs and the mounting portion 328. In a case where it is determined that the paper sheet M is present between the position at which the jam occurs and the mounting portion 328 (YES), the process transitions to Step S104 and in a case where it is determined that the paper sheet M is not present between the position at which the jam occurs and the mounting portion 328 (NO), the process transitions to Step S105.

In a case where the process transitions to Step S104, the paper sheet M on the downstream side of the position, at which the jam occurs, in the transportation path is transported to the mounting portion 328. That is, the paper sheet M which is in the transportation path while being positioned between the position at which the jam occurs and the mounting portion 328 is transported (recovered) to the mounting portion 328 by driving corresponding pairs of transportation rollers (pair of transportation rollers 131, pair of first transportation rollers 254, pair of second transportation rollers 256, pair of third transportation rollers 257, pair of first inverting rollers 265, pair of second inverting rollers 268, and pair of transportation rollers 327). Thereafter, the process transitions to Step S103.

For example, when the transportation detecting unit 199 detects an error and a jam occurs in the third discharging path 153 with the paper sheet M being present in the intermediate transportation path 218 or the downstream side transportation path 319, corresponding pairs of transportation rollers (pair of first transportation rollers 254, pair of second transportation rollers 256, pair of third transportation rollers 257, pair of first inverting rollers 265, pair of second inverting rollers 268, and pair of transportation rollers 327) are driven so that the paper sheet M in the intermediate transportation path 218 or the downstream side transportation path 319 is transported to the mounting portion 328.

In addition, for example, in the intermediate transportation device 200, when the introduction detecting unit 258, the first detecting unit 281, or the second detecting unit 282 detects an error and a jam occurs in the inlet path 243, the first branch path 244, or the second branch path 245 with the paper sheet M being present on the downstream side of a position, at which the jam occurs, in the transportation direction, corresponding pairs of transportation rollers (pair of second transportation rollers 256, pair of third transportation rollers 257, pair of first inverting rollers 265, pair of second inverting rollers 268, and pair of transportation rollers 327) are driven so that the paper sheet M in the first inversion path 248, the second inversion path 249, the first junction path 246, the second junction path 247, the outlet path 250, or the downstream side transportation path 319 is transported to the mounting portion 328.

In addition, for example, in the intermediate transportation device 200, when the first inversion detecting unit 264 or the second inversion detecting unit 267 detects an error and a jam occurs in the first inversion path 248 or the second inversion path 249 with the paper sheet M being present on the downstream side of a position, at which the jam occurs, in the transportation direction, corresponding pairs of transportation rollers (pair of second transportation rollers 256, pair of third transportation rollers 257, and pair of transportation rollers 327) are driven so that the paper sheet M in the first junction path 246, the second junction path 247, the outlet path 250, or the downstream side transportation path 319 is transported to the mounting portion 328.

In addition, for example, in the intermediate transportation device 200, when the third detecting unit 283 or the fourth detecting unit 284 detects an error and a jam occurs in the first junction path 246, the second junction path 247, or the first outlet path 250*a* with the paper sheet M being present on the downstream side of a position, at which the jam occurs, in the transportation direction, corresponding pairs of transportation rollers (pair of third transportation rollers 257 and pair of transportation rollers 327) are driven so that the paper sheet M in the outlet path 250 or the downstream side transportation path 319 is transported to the mounting portion 328.

In addition, for example, in the intermediate transportation device 200, when the fifth detecting unit 285 detects an error and a jam occurs in the second outlet path 250*b* with the paper sheet M being present on the downstream side of a position, at which the jam occurs, in the transportation direction, a corresponding pair of transportation rollers (pair of transportation rollers 327) is driven so that the paper sheet M in the downstream side transportation path 319 is transported to the mounting portion 328.

Note that, the above-described recovery transportation method of the paper sheet M is merely an example and arrangement of the detecting units in the transportation path and which driving motor corresponds to which detecting unit can be arbitrarily determined.

Next, in Step S105, the suppressing unit 450 is driven (activated). Specifically, the gap G between the first discharging roller 329*a* and the second discharging roller 329*b*, is changed to the second gap G2, which is smaller than the first gap G1, with the paper sheet M, which is mounted on the mounting portion 328, being interposed between the first discharging roller 329*a* and the second discharging roller 329*b*. That is, the first discharging roller 329*a* is moved from the first position Ps1 to the second position Ps2. Furthermore, the gap K between the paper sheet M mounted on the mounting portion 328 and the guiding surface 330*a* is changed to the second gap K2 which is smaller than the first gap K1. That is, the guiding unit 330 is moved from the first position Pk1 to the second position Pk2 (refer to FIG. 12).

Accordingly, although the paper sheet M mounted on the mounting portion 328 curls as time elapses, since the deformation (curling) of the paper sheet M is restricted by the pair of discharging rollers 329 and the guiding unit 330, it is possible to suppress the deformation (curling) of the paper sheet M.

In addition, after the jam occurs, the paper sheet M on the downstream side of a position at which the jam occurs is transported (recovered) to the mounting portion 328. Thereafter, the suppressing unit 450 is driven. Therefore, it is possible to prevent the paper sheet M being wastefully discarded.

Figure 16:
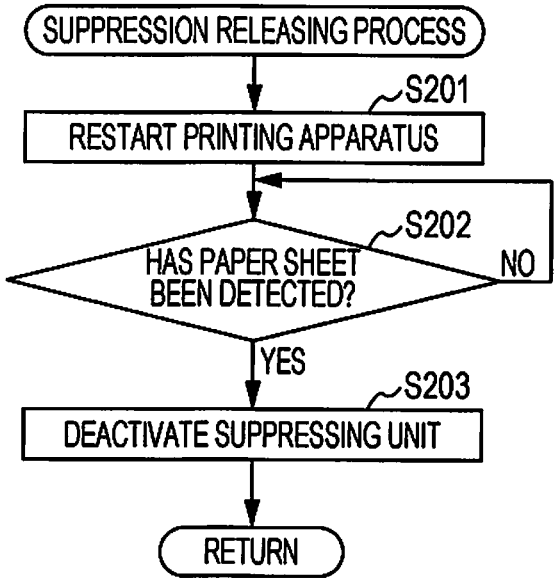
FIG. 16 is a flowchart illustrating a suppression releasing process.

Next, the suppression releasing process will be described. FIG. 16 is a flowchart illustrating the suppression releasing process.

First, in a case where the suppressing unit 450 is deactivated, it is necessary to fix the jam and the paper sheet M which causes the jam is drawn from the transportation path with fingers. In this manner, the jam is fixed.

In addition, the paper sheet M at the position at which the jam occurs and the paper sheet M in the recording unit 110 or the like are drawn from the printing system 1 in consideration of a processing unit of the paper sheet M on which the post processing unit 325 performs the post processing. Thereafter, after confirming that the error detected by the detecting units (transportation detecting unit 199, introduction detecting unit 258, first to fifth detecting units 281, 282, 283, 284, and 285, first and second inversion detecting units 264 and 267, and transportation detecting unit 356) is solved, the printing system 1 is restarted (Step S201).

Next, in Step S202, it is detected whether that the first paper sheet M which is transported after the jam is fixed can be mounted on the mounting portion 328 and a detecting unit, which is disposed on the upstream side of the suppressing unit 450 in the transportation path and is closest to the suppressing unit 450, (in present embodiment, fifth detecting unit 285*a* which is disposed in second outlet path 250*b* as transportation path and is closest to suppressing unit 450) has detected the first paper sheet M.

Specifically, for example, in a case where the printing system 1 is restarted in a state where all of the paper sheets M are removed from the third discharging path 153, the intermediate transportation path 218, and the downstream side transportation path 319, when the suppressing unit 450 is deactivated is important. That is, for example, if the suppressing unit 450 is deactivated when the paper sheet M which is transported first is detected by the introduction detecting unit 258 which is on the upstream side in the intermediate transportation path 218, since it takes time for the first paper sheet M to be transported to the mounting portion 328, the deformation (curling) of the paper sheet M mounted on the mounting portion 328 progresses. On the other hand, if a detecting unit, which is disposed on the upstream side of the mounting portion 328 in the transportation path and is closest to the mounting portion 328, simply detects the transportation of the first paper sheet M, the paper sheet M is transported to the mounting portion 328 in the middle of the deactivation of the suppressing unit 450, which may result in transportation failure of the paper sheet M.

Accordingly, it is necessary to secure a balance between a time taken for the paper sheet M to be transported to the mounting portion 328 after it is determined that the paper sheet M has been detected and a time taken for the deactivation of the suppressing unit 450 is finished after determination from the result of detection performed by the detecting unit. Therefore, it is determined whether the first paper sheet M which is transported after the jam occurs is detected or not on the basis of detection data from a detecting unit (fifth detecting unit 285*a* in the present embodiment) disposed at a position satisfying the above-described condition. Then, in a case where it is determined that the paper sheet M has been detected (YES), the process transitions to Step S203. On the other hand, in a case where it is determined that the paper sheet M has not been detected (NO), the process transitions to Step S202 again.

Next, in a case where the process transitions to Step S203, the suppressing unit 450 is deactivated. Specifically, the gap G between the first discharging roller 329*a* and the second discharging roller 329*b*, is changed from the second gap G2 to the first gap G1, with the paper sheet M, which is mounted on the mounting portion 328, being interposed between the first discharging roller 329*a* and the second discharging roller 329*b*.

That is, the first discharging roller 329*a* is moved from the second position Ps2 to the first position Ps1. Furthermore, the gap K between the paper sheet M mounted on the mounting portion 328 and the guiding surface 330*a* is changed to the first gap K1 to the second gap K2. That is, the guiding unit 330 is moved from the second position Pk2 to the first position Pk1 (refer to FIGS. 4 and 12).

Therefore, it is possible to secure a time taken for the suppressing unit 450 to suppress the deformation even after the jam is fixed.

According to the above-described embodiment, it is possible to achieve the following effect.

In a case where a jam occurs in the printing system 1, the paper sheet M mounted on the mounting portion 328 of the post processing device 300 is suppressed by the suppressing unit 450 (pair of discharging rollers 329 and guiding unit 330). Therefore, it is possible to suppress the curling of the paper sheet M. In addition, in a case where the jam is fixed, the suppressing unit 450 is driven until a time immediately before the first paper sheet M which is transported after the jam is fixed is transported to the mounting portion 328. Accordingly, even if the paper sheet M is transported to the mounting portion 328 after the jam is fixed, transportation failure due to the curling of the paper sheet M is not likely to occur. In addition, the paper sheets M on the mounting portion 328 are aligned in an orderly manner and thus it is possible to reliably perform the post processing.

Note that, the invention is not limited to the above-described embodiment and various modifications, improvements, and the like can be applied to the above-described embodiments. Modification examples will be described below.

Modification Example 1

In the above-described embodiment, the pair of discharging rollers 329 and the guiding unit 330 have been used as an example of the suppressing unit 450. However, the invention is not limited to this. For example, the suppressing unit 450 may be an air blower (various fans) and air may be sent to the paper sheet M mounted on the mounting portion 328 in a case where a jam occurs on the upstream side of the mounting portion 328 in the transportation path of the paper sheet M. Even in this case, it is possible to easily suppress the deformation such as the curling of the paper sheet M by using the air pressure of the sent air.

Modification Example 2

In the above-described embodiment, the pair of discharging rollers 329 and the guiding unit 330 have been used as an example of the suppressing unit 450. However, the invention is not limited to this. For example, as the suppressing unit 450, a moisturizing unit that can moisturize the paper sheet M mounted on the mounting portion 328 may be provided in addition to the pair of discharging rollers 329 and the guiding unit 330. The moisturizing mechanism or the moisturizing method of the moisturizing unit is not particularly limited and may be a vaporization-moisturizing method of moisturizing the paper sheet by sending air to a filter containing water or a steam-moisturizing method of boiling water with a heater and moisturizing the paper sheet by using vapor generated from the water. In addition, in a case where a jam occurs on the upstream side of the mounting portion 328 in the transportation path of the paper sheet M, the deformation of the paper sheet M is suppressed by the pair of discharging rollers 329 and the guiding unit 330 with the paper sheet M, which is mounted on the mounting portion 328, being moisturized by the moisturizing unit. In this case, the deformation of the paper sheet M is suppressed by the suppressing unit 450 with the paper sheet M being moisturized by the moisturizing unit in a case where a jam occurs. Therefore, it is possible to more efficiently suppress the curling of the paper sheet M.

Note that, in a case where the paper sheet M is moisturized, a surface or a region of the paper sheet M that is appropriately selected according to the curling state of the paper sheet M is moisturized. In this case, it is possible to further efficiently suppress the curling of the paper sheet M.

Modification Example 3

In the above-described embodiment, the printing system 1 is configured to include the printing device 100, the intermediate transportation device 200, and the post processing device 300. However, the invention is not limited to this. For example, the printing system 1 may be configured to include the printing device 100 that forms an image on a medium and the post processing device 300 that includes the mounting portion 328 on which the medium, on which the image has been formed, is temporarily mounted, the post processing unit 325 which performs post processing on the medium mounted on the mounting portion 328, and the suppressing unit 450 which suppresses deformation of the medium mounted on the mounting portion 328. That is, the intermediate transportation device 200 may be omitted. In addition, for example, the intermediate transportation device 200 and the printing device 100 may be integrated with each other and the intermediate transportation device 200 and the post processing device 300 may be integrated with each other. Even in this case, it is possible to suppress the deformation such as the curling of the medium by using the suppressing unit 450 in a case where the medium, on which an image has been formed by the printing device 100, is mounted on the mounting portion 328.

Modification Example 4

In the above-described embodiment, the guiding unit 330 includes the guiding surface 330*a* as a contact portion. However, the invention is not limited to this. For example, a projection portion that can come into point contact with the paper sheet M may be provided instead of the guiding surface 330*a* that come into surface contact with the paper sheet M.

Modification Example 5

In the above-described embodiment, the recording unit 110 in the printing device 100 includes the line-head type recording head 111 which can eject ink over the entire area in the width direction of the paper sheet M at once. However, the invention is not limited to this. For example, a serial head type printer may be provided. In addition, the printing device 100 may include a transportation path dedicated for simplex printing. Even in this case, it is possible to achieve the effect as described above.

Modification Example 6

In the above-described embodiment, in a case where a jam occurs on the upstream side of the mounting portion 328 in the transportation path of the paper sheet M, the deformation of the paper sheet M mounted on the mounting portion 328 is suppressed by the pair of discharging rollers 329 and the guiding unit 330. However, a time for suppressing the deformation of the paper sheet M is not limited to a time at which the jam occurs.

For example, the deformation of the paper sheet M mounted on the mounting portion 328 may be suppressed by the pair of discharging rollers 329 and the guiding unit 330 in a case as described below.

When the front plate cover 104 of the printing device 100 is opened.

When an intermediate transportation path cover (not shown), which is opened when a user accesses each transportation path in the intermediate transportation device 200, is opened.

When ink to be supplied to the printing device 100 has run out.

The entire disclosure of Japanese Patent Applications No. 2016-156219, filed Aug. 9, 2016, No. 2017-089382, filed Apr. 28, 2017, No. 2016-138251, filed Jul. 13, 2016, No. 2016-138252, filed Jul. 13, 2016, No. 2016-138253, filed Jul. 13, 2016, No. 2016-138256, filed Jul. 13, 2016, No. 2017-089383, filed Apr. 28, 2017, and No. 2016-138257, filed Jul. 13, 2016 are expressly incorporated by reference herein.

What is claimed is:

1. A post processing device comprising:

a mounting portion on which a medium, on which liquid has been ejected and an image has been formed in a printing device, is temporarily mounted;

a post processing unit that performs post processing on the medium mounted on the mounting portion;

a discharging tray on which the medium is stacked after being discharged; and a suppressing unit that suppresses deformation of the medium, the suppressing unit including a first roller, a second roller, and a contact portion, the first roller and the second roller being configured to interpose the medium therebetween and being configured to suppress the deformation of the medium, the first roller and the second roller being further configured to discharge the medium from the mounting portion to the discharging tray, the contact portion being coupled to the first roller and being rotatable around an axis of the first roller so as to come into contact with the medium, the mounting portion being a portion on which a plurality of mediums including the medium are configured to be temporarily and simultaneously mounted.

2. The post processing device according to claim 1, wherein, in a case where a situation in which the medium is not transported in a transportation path that is on the upstream side of the mounting portion occurs, the suppressing unit suppresses the deformation of the medium.

3. The post processing device according to claim 2, wherein the situation in which the medium is not transported is a situation in which the medium is jammed in the transportation path that is on the upstream side of the mounting portion.

4. The post processing device according to claim 3, wherein the suppressing unit is driven after the medium on the downstream side of a position, at which the jam occurs, in the transportation path is transported to the mounting portion.

5. The post processing device according to claim 4, wherein, in a case where the jam is fixed, the suppressing unit is deactivated on the basis of the result of detection performed by a detecting unit that is disposed in the transportation path on the upstream side of the suppressing unit and is closest to the suppressing unit.

6. A post processing device comprising:

a mounting portion on which at least one of mediums, on which liquid has been ejected and an image has been formed in a printing device, is configured to be temporarily mounted;

a post processing unit that performs post processing on the at least one of the mediums mounted on the mounting portion;

a discharging tray on which the at least one of the mediums is stacked after being discharged;

a transportation path that transports to the post processing unit the mediums on which the image has been formed in the printing device, the transportation path being arranged upstream in a transportation direction relative to the post processing unit;

a detecting unit that detects presence or absence of the mediums in the transportation path and is arranged at the transportation path;

a controller that determines that a first medium of the mediums is in an abnormal state based on a detection result of the detecting unit, the first medium being in the transportation path; and a suppressing unit that suppresses deformation of a second medium of the mediums, in response to the controller determining that the first medium is in the abnormal state, the second medium being different from the first medium and mounted on the mounting portion.

7. The post processing device according to claim 6, wherein the suppressing unit is an air blower, and wherein, in a case where a situation in which the medium is not transported in a transportation path that is on the upstream side of the mounting portion occurs, air is sent to the medium mounted on the mounting portion.

8. The post processing device according to claim 7, wherein the suppressing unit includes a moisturizing unit that moisturizes the medium mounted on the mounting portion, and wherein, in a case where a situation in which the medium is not transported in a transportation path that is on the upstream side of the mounting portion occurs, the medium mounted on the mounting portion is moisturized.

9. The post processing device according to claim 1, wherein the suppressing unit suppresses the deformation of the medium between the mounting portion and the discharging tray.

10. The post processing device according to claim 9, wherein a gap in a direction in which the medium is interposed between the first roller and the second roller is changeable to a first gap and a second gap that is a gap smaller than the first gap, and wherein, in a case where a situation in which the medium is not transported in a transportation path that is on the upstream side of the mounting portion occurs, the gap between the first roller and the second roller is changed to the second gap with the medium, which is mounted on the mounting portion, being interposed between the first roller and the second roller.

11. The post processing device according to claim 10, wherein, in a case where the gap is the first gap, any one of the first roller and the second roller does not come into contact with the medium, and wherein, in a case where the gap is the second gap, the first roller and the second roller come into contact with the medium.

12. The post processing device according to claim 1, wherein the suppressing unit suppresses the deformation of the medium on the mounting portion.

13. The post processing device according to claim 12, wherein a gap between the medium mounted on the mounting portion and the contact portion is changeable to a first gap and a second gap that is a gap smaller than the first gap, and wherein, in a case where a situation in which the medium is not transported in a transportation path that is on the upstream side of the mounting portion occurs, the gap between the medium mounted on the mounting portion and the contact portion is changed to the second gap.

14. The post processing device according to claim 13, wherein, in a case where the gap is the first gap, the contact portion does not come into contact with the medium, and wherein, in a case where the gap is the second gap, the contact portion comes into contact with the medium.

15. A printing system comprising:

a printing device that ejects liquid to form an image on a medium; and a post processing device that includes a mounting portion on which the medium, on which the image has been formed, is temporarily mounted, a post processing unit which performs post processing on the medium mounted on the mounting portion, a discharging tray on which the medium is stacked after being discharged, and a suppressing unit which suppresses deformation of the medium mounted on the mounting portion, the suppressing unit including a first roller, a second roller, and a contact portion, the first roller and the second roller being configured to interpose the medium therebetween and being configured to suppress the deformation of the medium, the first roller and the second roller being further configured to discharge the medium from the mounting portion to the discharging tray, the contact portion being coupled to the first roller and being rotatable around an axis of the first roller so as to come into contact with the medium, the mounting portion being a portion on which a plurality of mediums including the medium are configured to be temporarily and simultaneously mounted.

16. A printing system comprising:

a printing device that ejects liquid to form an image on mediums;

a post processing device that includes a mounting portion on which at least one of the mediums, on which the image has been formed, is temporarily mounted, a post processing unit which performs post processing on the at least one of the mediums mounted on the mounting portion, and a suppressing unit which suppresses deformation of the at least one of the mediums mounted on the mounting portion;

an intermediate transportation device that transports the mediums, on which the image has been formed in the printing device, to the post processing device;

a detecting unit that detects presence or absence of the mediums in the intermediate transportation device, and is arranged at the intermediate transportation device; and a controller that determines that a first medium of the mediums is in an abnormal state based on a detection result of the detecting unit, the first medium being in the intermediate transportation device, the suppressing unit suppressing deformation of a second medium of the mediums in response to the controller determining that the first medium is in the abnormal state, the second medium being different from the first medium and mounted on the mounting portion.

* * * * *